US009336702B2

(12) United States Patent
Kim et al.

(10) Patent No.: US 9,336,702 B2
(45) Date of Patent: May 10, 2016

(54) DISPLAY APPARATUS AND METHOD OF DRIVING THE SAME USING PHOTONIC AND ELECTROPHORESIS PRINCIPLE

(75) Inventors: Sangil Kim, Yongin-si (KR); Jang-Kyum Kim, Osan-si (KR); Myung-Eun Kim, Seongnam-si (KR); Namseok Roh, Seongnam-si (KR); Gilhwan Yeo, Hwaseong-si (KR); Yeun Tae Kim, Suwon-si (KR); KyoungHo Lim, Yongin-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 472 days.

(21) Appl. No.: 13/441,074

(22) Filed: Apr. 6, 2012

(65) Prior Publication Data

US 2013/0033531 A1 Feb. 7, 2013

(30) Foreign Application Priority Data

Aug. 1, 2011 (KR) ..... 10-2011-0076735

(51) Int. Cl.

| | |
|---|---|
| ***G09G 5/10*** | (2006.01) |
| ***G09G 5/02*** | (2006.01) |
| ***G09G 3/20*** | (2006.01) |
| ***G09G 3/34*** | (2006.01) |

(52) U.S. Cl.

CPC ..... *G09G 3/2003* (2013.01); *G09G 3/2007* (2013.01); *G09G 3/344* (2013.01); *G09G 2300/023* (2013.01); *G09G 2300/0452* (2013.01); *G09G 2310/0262* (2013.01); *G09G 2340/00* (2013.01)

(58) Field of Classification Search

CPC ..... G09G 3/2074; G09G 3/2077; G09G 3/3433–3/3453

USPC ..... 345/204–215, 690–695; 359/589

See application file for complete search history.

(56) References Cited

U.S. PATENT DOCUMENTS

| | | | | |
|---|---|---|---|---|
| 2004/0222999 | A1* | 11/2004 | Choi et al. | 345/589 |
| 2007/0013649 | A1* | 1/2007 | Kim et al. | 345/107 |
| 2008/0278433 | A1* | 11/2008 | Lee et al. | 345/107 |
| 2012/0293858 | A1* | 11/2012 | Telfer et al. | 359/296 |

FOREIGN PATENT DOCUMENTS

| | | | |
|---|---|---|---|
| JP | 2003-344831 | A | 12/2003 |
| JP | 2008-008951 | A | 1/2008 |
| JP | 2009-192638 | A | 8/2009 |
| KR | 1020070010636 | A | 1/2007 |
| KR | 1020100091140 | A | 8/2010 |

* cited by examiner

*Primary Examiner* — Jimmy H Nguyen
*Assistant Examiner* — Hang Lin
(74) *Attorney, Agent, or Firm* — Cantor Colburn LLP

(57) ABSTRACT

A display apparatus includes an image data comparator which receives first, second and third color image data, extracts first, second and third image data from the first, second and third color image date by comparing gray scale values of the first, second and third color image date such that each of grayscale values of the second and third image data is greater than or equal to a gray scale value of the first image data, and compares the gray scale value of the first image data with a predetermined gray scale value, a driving circuit which generates a gray scale signal based on a result of the comparison and generates first and second color signals based on the first, second or third image data, and a pixel including a first sub-pixel which receives the gray scale signal, second and third sub-pixels which receive the first and second color signals, respectively.

17 Claims, 18 Drawing Sheets

DISPLAY APPARATUS AND METHOD OF DRIVING THE SAME USING PHOTONIC AND ELECTROPHORESIS PRINCIPLE

This application claims priority to Korean Patent Application No. 10-2011-0076735, filed on Aug. 1, 2011, and all the benefits accruing therefrom under U.S.C. §119, the content of which in its entirety is herein incorporated by reference.

BACKGROUND OF THE INVENTION

1. Field of the Invention

Exemplary embodiments of the invention relate to a display apparatus that displays various gray scales and a method of driving the display apparatus.

2. Description of the Related Art

In recent, a display apparatus using the photonic crystal principle and the electrophoresis principle has been developed as a next-generation display apparatus.

The display apparatus using the electrophoresis principle uses the phenomenon of electrophoresis, in which electrophoretic particles move in dispersing medium by an electric field generated between a pair of substrates. However, the display apparatus employing the electrophoresis principle may display only a limited number of colors.

The display apparatus using the photonic crystal principle uses a material or crystal that represents a color corresponding to the specific wavelength by reflecting light in a specific wavelength when light is incident thereto and transmitting remaining light of the incident light. The photonic crystal may be artificially synthesized, and a crystal structure and a crystal period of the photonic crystal are effectively modified such that the wavelength of the light to be reflected, which may be visible light, an ultraviolet ray or an infrared ray, for example, is effectively controlled.

However, the display apparatus employing the photonic crystal principle may display only a limited number of gray scales.

BRIEF SUMMARY OF THE INVENTION

Exemplary embodiments of the invention provide a display apparatus that displays various colors and gray scales using a photonic crystal principle.

Exemplary embodiments of the invention provide a display apparatus that displays various colors and gray scales using an electrophoresis principle.

Exemplary embodiments of the invention provide a method of driving the display apparatus.

According to an exemplary embodiment, a display apparatus includes an image data comparator, a driving circuit and a display panel. The image data comparator receives a pixel image data including a first color image data, a second color image data and a third color image data, extracts a first image data, a second image data and a third image data from the first color image date, the second color image data and the third color image data by comparing gray scale values of the first color image date, the second color image data and the third color image data with each other such that each of a grayscale value of the second image data and a grayscale value of the third image data is greater than or equal to a gray scale value of the first image data, and compares the gray scale value of the first image data with a predetermined gray scale value. The driving circuit generates a gray scale signal based on a compared result of the gray scale value of the first image data and the predetermined gray scale value and generates a first color signal and a second color signal based on at least one of the first image data, the second image data and the third image data, where each of the first and second color signals includes at least one color information. The pixel includes a first sub-pixel which receives the gray scale signal to display a gray scale, a second sub-pixel which receives the first color signal to display at least one color, and a third sub-pixel which receives the second color signal to display at least one color.

According to an exemplary embodiment, a method of driving a display apparatus, including a pixel including a first sub-pixel which displays a gray scale, a second sub-pixel which displays at least one color, and a third sub-pixel which displays at least one color, includes: receiving a pixel image data including a first color image data, a second color image data and a third color image data; extracting a first image, a second image data and a third image data by comparing gray scale values of the first color image date, the second color image data and the third color image data with each other such that each of a grayscale value of the second image data and a grayscale value of the third image data is greater than or equal to a gray scale value of the first image data; comparing the gray scale value of the first image data with a predetermined gray scale value; generating a gray scale signal based on the comparing the gray scale value of the first image data and the predetermined gray scale value; generating a first color signal and a second color signal based on at least one of the first image data, the second image data and the third image data, wherein each of the first and second color signals includes at least one color information; applying the gray scale signal to the first sub-pixel to display a gray scale corresponding to a gray scale level in gray scale levels from a black gray scale to a white gray scale; and respectively applying the first color signal and the second color signal to the second sub-pixel and the third sub-pixel to display the at least one color.

According to an exemplary embodiment, a display apparatus includes an upper display panel, a lower display panel, an image data comparator-converter and a driving circuit. The upper display panel includes a first pixel including a first sub-pixel, a second sub-pixel and a third sub-pixel, where each of the first sub-pixel, the second sub-pixel and the third sub-pixel includes a photonic crystal material. The lower display panel is disposed under the upper display panel and comprising a second pixel including a fourth sub-pixel, a fifth sub-pixel and a sixth sub-pixel corresponding to the first, second, and third sub-pixels, respectively, where each of the fourth sub-pixel, the fifth sub-pixel and the sixth sub-pixel includes a photonic crystal material. The image data comparator-converter receives a pixel image data including a first color image data, a second color image data and a third color image data, and compares gray scale values of the first, second and third color image data with each other, where the image data comparator-converter generates a first image data having ratio information of the gray scale values of the first, second and third color image data with respect to a maximum gray scale value of the pixel image data when the gray scale values of the first, second and third color image data are the same, and generates a second image data when the gray scale values of the first, second and third color image data are different from each other. The driving circuit generates a driving signal based on the first image data or the second image data and applies the driving signal to the upper display panel and the lower display panel.

According to exemplary embodiments, the first pixel may display a gray scale level of gray scale levels from the black gray scale to the white gray scale and each of the second and third pixels may display at least one color.

In an exemplary embodiment, the color information and the gray scale information in each of the first, second and third color image data are mixed with each other, and various colors and gray scales are thereby effectively displayed.

In an exemplary embodiment, the first pixel and the second pixel operate complementary to each other to display a gray scale level of gray scale levels from the black gray scale to the white gray scale. In an exemplary embodiment, the first pixel and the second pixel operate complementary to each other to display a specific color. The specific color displayed in the first and second pixels has a specific chroma and a specific brightness and the gray scale of the color displayed in the first and second pixels is determined based on the specific chroma and the specific brightness.

BRIEF DESCRIPTION OF THE DRAWINGS

The above and other features and aspects of the invention will become readily apparent by reference to the following detailed description when considered in conjunction with the accompanying drawings, in which.

DETAILED DESCRIPTION OF THE INVENTION

Figure 1:
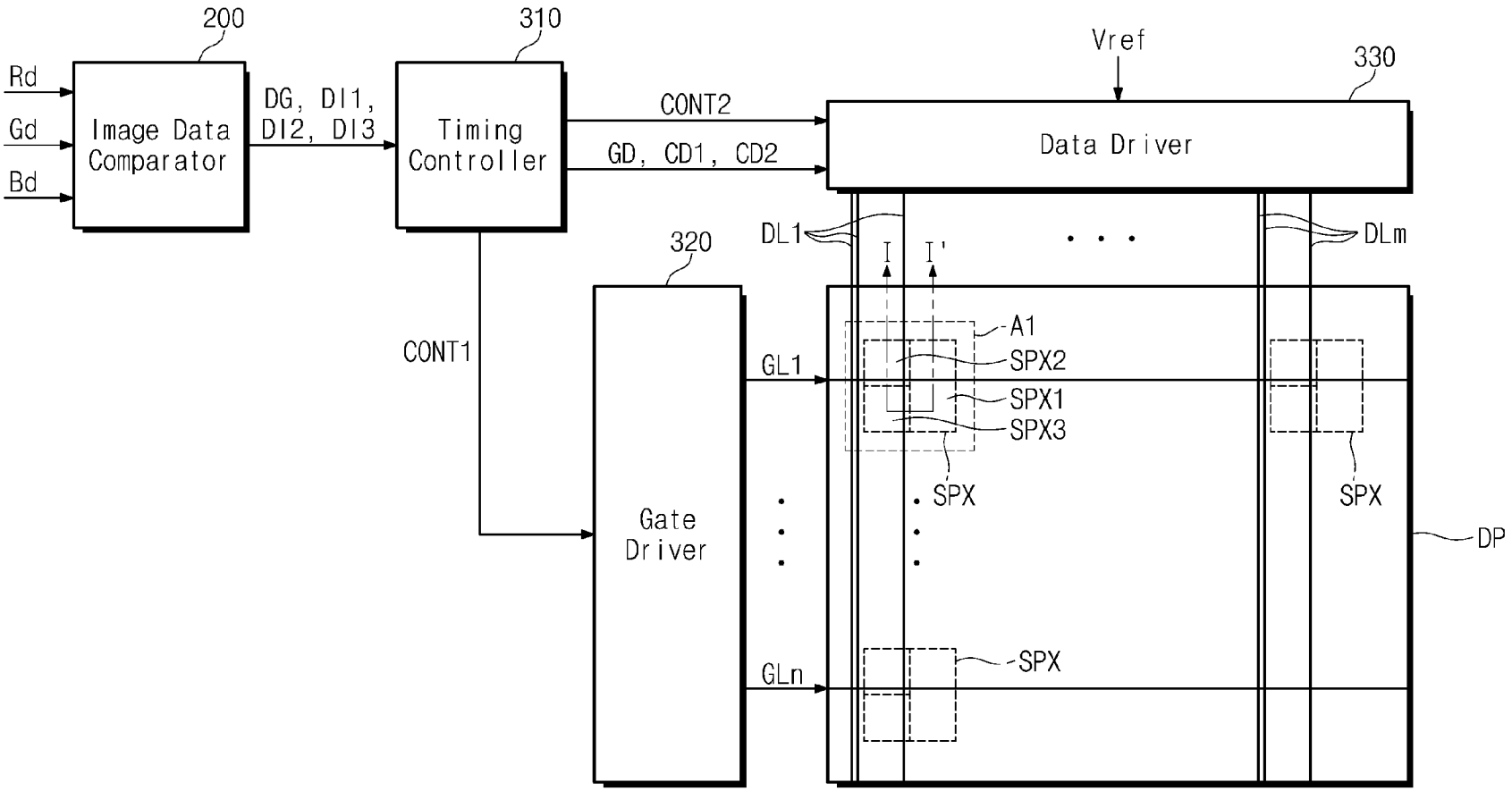
FIG. 1 is a block diagram showing an exemplary embodiment of a display apparatus according to the invention.

The invention now will be described more fully hereinafter with reference to the accompanying drawings, in which various embodiments are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, the invention will be explained in detail with reference to the accompanying drawings.

Figure 2:
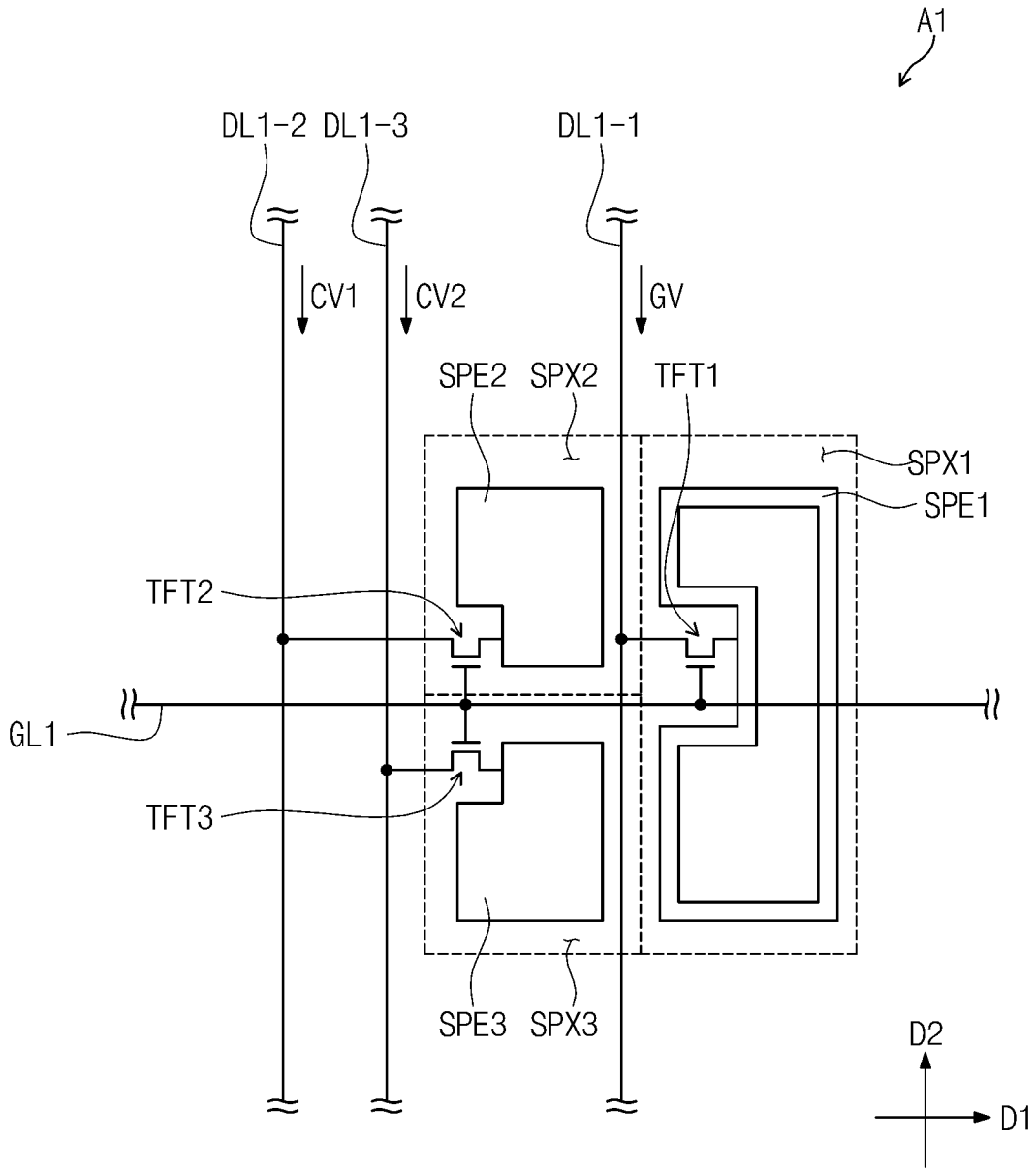
FIG. 2 is a partially enlarged view of a portion A1 shown in FIG. 1.
Figure 3A:
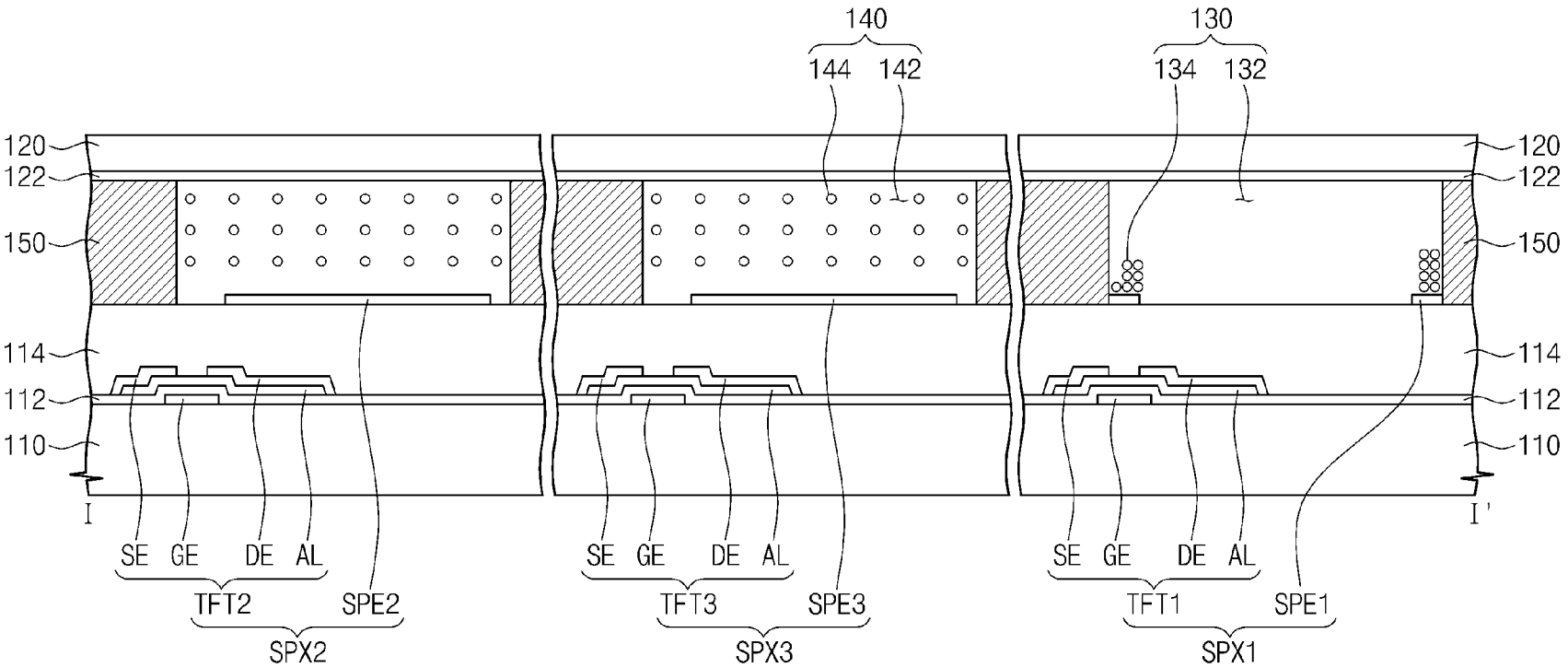
FIGS. 3A and 3B are cross-sectional views taken along line I-I' shown in FIG. 1.
Figure 3B:
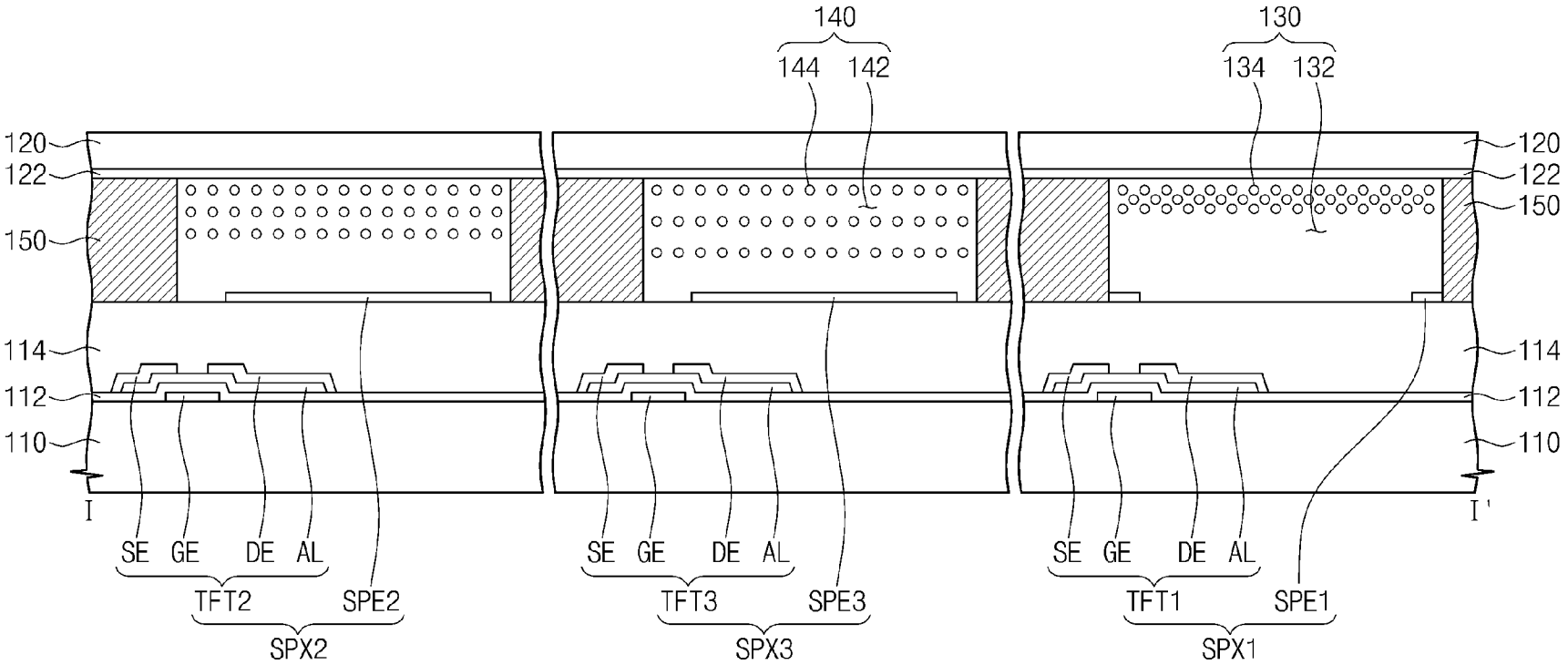

FIG. 1 is a block diagram showing an exemplary embodiment of a display apparatus according to the invention, FIG. 2 is a partially enlarged view of a portion A1 shown in FIG. 1, and FIGS. 3A and 3B are cross-sectional views taken along line I-I' shown in FIG. 1.

Referring to FIGS. 1, 2, 3A and 3B, a display apparatus includes an image data comparator 200, a driving circuit and a display panel DP.

The driving circuit includes a timing controller 310, a gate driver 320 and a data driver 330. In an exemplary embodiment, the display panel DP includes two substrates opposite to, e.g., facing, each other and a plurality of pixels PX disposed between the two substrates. Each of pixels PX includes a first sub-pixel SPX1, a second sub-pixel SPX2 and a third sub-pixel SPX3. The pixels PX may be arranged substantially in a matrix form. In an exemplary embodiment, as shown in FIG. 1, each of the pixels PX includes three sub-pixels, but not being limited thereto. In an alternative exemplary embodiment, the number of the sub-pixels may be less than or greater than three.

The display panel DP includes a first substrate 110 and a second substrate 120 disposed opposite to, e.g., facing, the first substrate 110 and spaced apart from the first substrate 110. The first substrate 110 includes a plurality of first lines GL1 to GLn extending in a first direction D1 and a plurality of second lines DL1 to DLm extending in a second direction D2 crossing the first direction D1 and insulated from the first lines GL1 to GLn. Each of the second lines DL1 to DLm includes a first sub-line DL1-1, a second sub-line DL1-2 and a third line DL1-3. The first, second and third sub-lines DL1-1, DL1-2 and DL1-3 are electrically insulated from each other. In an exemplary embodiment, the second substrate 120 includes a common electrode 122 disposed on a surface thereof facing the first substrate 110.

The first sub-pixel SPX1 includes a first sub-pixel electrode SPE1 and a first thin film transistor TFT1, which are disposed on the first substrate 110. The first thin film transistor TFT1 is connected to the first sub-line DL1-1 (e.g., a first sub-data line of a first data line DL1), the first sub-pixel electrode SPE1 and one of the first lines GL1 to GLn (e.g., a first gate line GL1). In an exemplary embodiment, the first sub-pixel SPX1 includes an electrophoretic material 130 interposed between the first sub-pixel electrode SPE1 and the common electrode 122.

The electrophoretic material 130 includes a dielectric solvent 132 and a plurality of electrophoretic particles 134 dispersed in the dielectric solvent 132. The electrophoretic particles 134 may have a predetermined polarity and a predetermined color.

In an exemplary embodiment, the first sub-pixel SPX1 controls an arrangement of the electrophoretic material 130 to adjust a reflectance of light incident to the first sub-pixel SPX1. In such an embodiment, the first sub-pixel SPX1 may display various gray scales.

Hereinafter, an exemplary embodiment, in which the electrophoretic particles 134 have a positive (+) polarity and a white color, will now be described, but the invention is not limited thereto. In such an embodiment, a protective layer 114 have a black color, but the invention is note limited thereto. In an alternative exemplary embodiment, the protective layer 114 does not have the black color, and the display panel DP may further include a color layer disposed on the protective layer 114 and having the black color.

In an exemplary embodiment, the first sub-pixel electrode SPE1 is disposed only in a portion of the first sub-pixel SPX1, as shown in FIG. 2. In an exemplary embodiment, the first sub-pixel electrode SPE1 may have an enclosed shape including an opening formed therein, as shown in FIG. 2.

In an exemplary embodiment, where the electrophoretic particles 134 have a black color, the protective layer 114 may include a material to serve as a reflection plate or a separate reflection plate may be further disposed on the protective layer 114. In an alternative exemplary embodiment, where the electrophoretic material includes white electrophoretic particles and black electrophoretic particles having a polarity different from a polarity of the white electrophoretic particles, the black gray scale may be displayed using only the electrophoretic material.

The second sub-pixel SPX2 includes a second sub-pixel electrode SPE2 and a second thin film transistor TFT2, which are disposed on the first substrate 110. The second thin film transistor TFT2 is connected to the second sub-line DL1-2 (e.g., a second sub-data line of the first date line DL1), the second sub-pixel electrode SPE2 and the first gate line GL1. The second sub-pixel SPX2 includes a photonic crystal material 140 interposed between the second sub-pixel electrode SPE2 and the common electrode 122.

The third sub-pixel SPX3 includes a third sub-pixel electrode SPE3 and a third thin film transistor TFT3, which are disposed on the first substrate 110. The third thin film transistor TFT3 is connected to the third sub-line DL1-3 (e.g., a third sub-data line of the first data line DL1), the third sub-pixel electrode SPE3 and the first gate line GL1. The third sub-pixel SPX3 includes the photonic crystal material 140 interposed between the third sub-pixel electrode SPE3 and the common electrode 122.

The photonic crystal material 140 includes a dielectric solvent 142 and a plurality of photonic crystal particles 144 dispersed in the dielectric solvent 142. The photonic crystal particles 144 may have a core-shell structure including two different materials or a multi-core structure including two different materials. In an exemplary embodiment, the photonic crystal particles 144 may be a cluster having a plurality of nanoparticles.

In an exemplary embodiment, the photonic crystal particles 144 have the same polarity. In such an embodiment, a force of repulsion exists between the photonic crystal particles 144, and the photonic crystal particles 144 are spaced apart from each other at regular intervals while being arranged. Each of the second sub-pixel SPX2 and the third sub-pixel SPX3 reflect light in a specific wavelength to display colors. An exemplary embodiment of a method of displaying the colors using the second and third sub-pixels SPX2 and SPX3 will be described later in greater detail.

In an exemplary embodiment, where the number of the sub-pixels included in each pixel PX is equal to or greater than three, one or more sub-pixels include the electrophoretic material 130 as the first sub-pixel SPX1.

Each of the first, second and third thin film transistors TFT1, TFT2 and TFT3 includes a gate electrode GE, a source electrode SE and a drain electrode DE. The gate electrode of each of the first, second and third thin film transistors TFT1, TFT2 and TFT3 is branched from the first gate line GL1. A gate insulating layer 112 is disposed on the first substrate 110 covering the first gate line GL1 and the gate electrode GE. An active layer AL is disposed on the gate insulating layer 112. The active layer AL is disposed in areas, in which the first, second and third thin film transistors TFT1, TFT2 and TFT3 are respectively disposed, in an island shape. The source electrode SE and the drain electrode DE are disposed on the active layer AL to be spaced apart from each other such that a portion of the active layer AL is exposed.

In an exemplary embodiment, the first, second and third sub-data lines DL1-1, DL1-2 and DL1-3 are disposed on the gate insulating layer 112. The source electrodes of the first, second and third thin film transistors TFT1, TFT2 and TFT3 are branched from the first, second and third sub-data lines DL1-1, DL1-2 and DL1-3, respectively.

The protective layer 114 is disposed on the gate insulating layer 112 covering the source electrode SE, the drain electrode DE and the exposed portion of the active layer AL. The protective layer 114 includes an insulating material. The first, second and third sub-pixel electrodes SPE1, SPE2 and SPE3 are disposed on the protective layer 114. First, second and third contact holes (not shown) may be formed through the protective layer 114 such that portions of the drain electrodes of the first, second and third thin film transistors TFT1, TFT2 and TFT3 are exposed by the first, second and third contact holes, respectively. The first, second and third sub-pixel electrodes SPE1, SPE2 and SPE3 are respectively connected to the drain electrodes of the first, second and third thin film transistors TFT1, TFT2 and TFT3 through the first, second and third contact holes.

When a gate voltage is applied to the first gate line GL1, the first, second and third thin film transistors TFT1, TFT2 and TFT3 are substantially simultaneously turned on. Data voltages respectively applied to the first, second and third sub-data lines DL1-1, DL1-2 and DL1-3 are charged in the first, second and third sub-pixel electrodes SPE1, SPE2 and SPE3, respectively, through the turned-on first, second and third thin film transistors TFT1, TFT2 and TFT3.

In an exemplary embodiment, the first, second and third sub-pixels SPX1, SPX2 and SPX3 may be spatially separated from each other by a barrier wall 150 disposed between the first substrate 110 and the second substrate 120. In such an embodiment, the electrophoretic material 130 and the photonic crystal material 140, which are included in different sub-pixels from each other, are not mixed with each other. In an alternative exemplary embodiment, the electrophoretic material 130 and the photonic crystal material 140 may enclosed in microcapsules such that the electrophoretic material 130 is separated from the photonic crystal material 140.

The first sub-pixel SPX1 may have an area larger than an area of the second and third sub-pixels SPX2 and SPX3 when viewed in a top plan view. As shown in FIG. 2, the area of the first sub-pixel SPX1 may be about twice the area of the second sub-pixel SPX2 in a plan view, and the area of the second sub-pixel SPX2 may be substantially equal to the area of the third sub-pixel SPX3. However, the areas of the first, second and third sub-pixels SPX1, SPX2 and SPX3 should not be limited to the above-mentioned areas.

Referring to FIGS. 3A and 3B, the first sub-pixel SPX1 displays various gray scales based on the arrangement of the electrophoretic particles 134. The arrangement of the electrophoretic particles 134 changes based on a level and a polarity of a driving voltage applied to the electrophoretic material 130 and a voltage application time period of the driving voltage. When a pixel voltage and a common voltage are applied to the first sub-pixel electrode SPE1 and the common electrode 122, respectively, the driving voltage is applied to the electrophoretic material 130. The pixel voltage may be the data voltage charged in the first sub-pixel electrode SPE1 through the turned-on first thin film transistor TFT1.

When the level of the common voltage is lower than the level of the pixel voltage, the driving voltage has a positive (+) polarity, and the driving voltage has a negative (−) polarity when the level of the common voltage is higher than the level of the pixel voltage. In an exemplary embodiment, the level of the common voltage is constant, and the level of the pixel voltage may be swung with reference to the level of the common voltage to change the polarity of the driving voltage.

As shown in FIG. 3A, when the driving voltage having the negative (−) polarity is applied to the electrophoretic material 130, the electrophoretic particles 134 having the positive (+) polarity are arranged adjacent to the first sub-pixel electrode SPE1. Accordingly, the light incident to the first sub-pixel SPX1 is absorbed by the protective layer 114 having the black color without being reflected by the electrophoretic material 130, such that the first sub-pixel SPX1 displays the black gray scale.

When the driving voltage having the positive (+) polarity is applied to the electrophoretic material 130, the electrophoretic particles 134 are arranged adjacent to the common electrode 122. Accordingly, the light incident to the first sub-pixel SPX1 is reflected by the electrophoretic particles 134, such that the first sub-pixel SPX1 displays the white gray scale.

When the driving voltage having the positive (+) polarity and gradually varied is applied to the first sub-pixel SPX1 displaying the black gray scale, the first sub-pixel SPX1 may sequentially display gray scales gradually varied between the black gray scale and the white gray scale.

The driving voltage having the positive (+) polarity may be gradually applied to the first sub-pixel SPX1 by controlling the level or the voltage application time period of the pixel voltage. In one exemplary embodiment, for example, when the first sub-pixel SPX1 displays the white gray scale by applying the driving voltage having the positive (+) polarity to the first sub-pixel SPX1 during H time period, e.g., a time period of a unit frame, the first sub-pixel SPX1 may display an intermediate gray scale by applying the driving voltage having the positive (+) polarity to the first sub-pixel SPX1 during H/2 time period.

Hereinafter, an exemplary embodiment of a method of displaying colors through the second and third sub-pixels SPX2 and SPX3 will be described with reference to FIGS. 3A and 3B.

As shown in FIG. 3A, when the driving voltage is not applied to the photonic crystal material 140 or the driving voltage having the positive (+) polarity is applied to the photonic crystal material 140 at a relatively low level, the force of repulsion occurs between the photonic crystal particles 144 having the positive (+) polarity. Thus, a distance between the photonic crystal particles 144 increases and an incident light passes through the photonic crystal material 140 such that the second and third sub-pixels SPX2 and SPX3 display the black color by the protective layer 114 having the black color.

As shown in FIG. 3B, when the driving voltage having the positive (+) polarity is applied to the photonic crystal material 140 at a relatively high level, the photonic crystal particles 144 move toward the common electrode 122. The force of repulsion between the photonic crystal particles 144 is offset by a force of attraction between the common electrode 122 and the photonic crystal particles 144. As the level of the driving voltages becomes high, the distance between the photonic crystal particles 144 decreases and the photonic crystal particles 133 reflects light in a short wavelength. In one exemplary embodiment, for example, the third sub-pixel SPX3 displays a red color in response to a first driving voltage applied thereto, and the second sub-pixel SPX2, to which a second driving voltage having a level higher than the level of the first driving voltage is applied, may display a green color. In such an embodiment, the second and third sub-pixels SPX2 and SPX3 display the light in the short wavelength as the level of the pixel voltage becomes high.

Hereinafter, the image data comparator 200, the timing controller 310, the gate driver 320 and the data driver 330 will be described in detail with reference to FIGS. 1 and 2.

The image data comparator 200 receives a plurality of pixel image data on a frame-by-frame basis. A pixel image data has information of the light displayed through a pixel. The pixel image data includes a first color image data Rd, a second color image data Gd and a third color image data Bd. In an exemplary embodiment, the first, second and third color image data Rd, Gd and Bd include red information, green information and blue information, respectively. In an exemplary embodiment, each of the first, second and third color image data Rd, Gd and Bd include gray scale information.

The image data comparator 200 compares gray scale values of the first, second and third color image data Rd, Gd and Bd with each other to extract a color image data having the lowest gray scale as a first image data DI1. The image data comparator 200 extracts color image data having the gray scale larger than the first image data DI1 as a second image data DI2 and a third image data DI3. When two color image data of the first, second and third color image data Rd, Gd and Bd have the same gray scale value and remaining one color image data has the gray scale value smaller than the gray scale value of the two color image data, one of the two color image data is extracted as the first image data DI1.

The image data comparator 200 provides the first, second and third image data DI1, DI2 and DI3 to the timing controller 310. The first image data DI1 has the color information and the gray scale information of the color image data having the lowest gray scale value of the first, second and third color image data Rd, Gd and Bd. The second image data DI2 and the third image data DI3 have the color information and the gray scale information of the other two color image data of the first, second and third color image data Rd, Gd and Bd.

The image data comparator 200 compares the gray scale value of the first image data DI1 with a predetermined gray scale value and outputs a comparison result data DG obtained by comparing the gray scale value of the first image data DI1 with the predetermined gray scale value.

The timing controller 310 receives the comparison result data DG and the first, second and third image data DI1, DI2 and DI3. The timing controller 310 generates a gray scale data GD based on the comparison result data DG and generates a first color data CD1 and a second color data CD2 based on at least one of the first, second and third image data DI1, DI2 and DI3. The gray scale data GD includes information of a ratio of a gray scale value G1 of the first image data DI1 to the predetermined gray scale value.

The timing controller 310 receives various control signals, such as a vertical synchronizing signal, a horizontal synchronizing signal, a main clock and a data enable signal, for example.

Based on the control signals, the timing controller 310 applies a gate control signal CONT1 to the gate driver 320 and applies the gray scale data GD, the first color data CD1, the second color data CD2 and a data control signal CONT2 to the data driver 330.

The gate control signal CONT1 includes a vertical synchronization start signal that indicates the starting of an output of a gate-on pulse (e.g., a gate-on voltage period), a gate clock signal that controls the output timing of the gate-on pulse and a gate-on enable signal that determines the width of the gate-on pulse.

The data control signal CONT2 includes a horizontal start signal that instructs a start of the operation of the data driver 330, an inverting signal and an output indicating signal.

The gate driver 320 sequentially applies the gate voltage to the gate lines GL1 to GLn in response to the gate control signal CONT1.

The data driver 330 receives the gray scale data GD, the first color data CD1 and the second color data CD2 from the timing controller 310. In an exemplary embodiment, the data driver 330 converts the gray scale data GD, the first color data CD1 and the second color data CD2 into a gray scale signal GV, a first color signal CV1 and a second color signal CV2, respectively.

When the gate voltage is applied to the first gate line GL1, the gray scale signal GV, the first color signal CV1 and the second color signal CV2 are applied to the first, second and third sub-data lines DL1-1, DL1-2 and DL1-3, respectively. The first thin film transistor TFT1 outputs the gray scale signal GV provided through the first sub-data line DL1-1 in response to the gate voltage. The second thin film transistor TFT2 outputs the first color signal CV1 provided through the second sub-data line DL1-2 in response to the gate voltage and the third thin film transistor TFT3 outputs the second color signal CV2 provided through the third sub-data line DL1-3 in response to the gate voltage. In such an embodiment, the first, second and third sub-pixel electrodes SPE1, SPE2 and SPE3 are charged with the gray scale signal, the first color signal and the second color signal.

The first sub-pixel SPX1 receives the gray scale signal GV and displays a predetermined gray scale. The electrophoretic particles 134 are arranged in a predetermined pattern by an electric field generated by the common voltage and the gray scale signal GV charged in the first sub-pixel electrode SPE1 to control the reflectance of the light such that the predetermined gray scale is displayed.

The second sub-pixel SPX2 receives the first color signal CV and displays a predetermined color. The photonic crystal particles 144 are arranged in a predetermined pattern by an electric field generated by the common voltage and the first color signal CV1 charged in the second sub-pixel electrode SPE1 to reflect light in the specific wavelength such that the predetermined color is displayed. The third sub-pixel SPX3 receives the second color signal CV2 to display a predetermined color.

Figure 4:
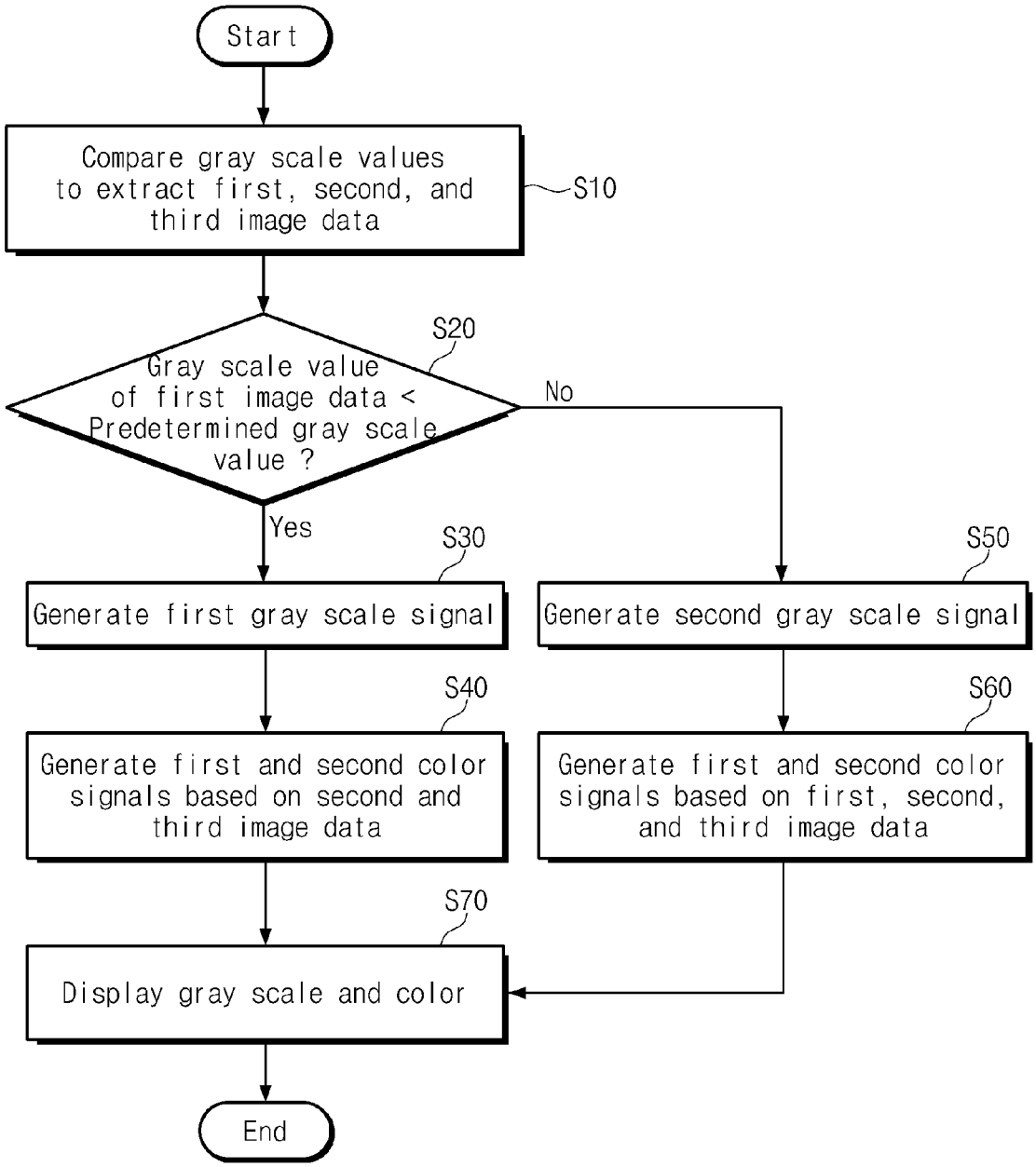
FIG. 4 is a flowchart showing an exemplary embodiment of a driving method of the display apparatus shown in FIG. 1.

FIG. 4 is a flowchart showing an exemplary embodiment of a driving method of the display apparatus shown in FIG. 1, FIGS. 5A to 5E are graphs showing gray scale values of first, second and third color image data, and FIGS. 6A to 6E are graphs showing gray scale values of first, second and third image data respectively extracted from the first, second and third color image data shown in FIGS. 5A to 5E. Hereinafter, an exemplary embodiment of the method of driving the display apparatus will be described in greater detail.

In an exemplary embodiment, as shown in FIG. 4, the image data comparator 200 compares the gray scale values of the first, second and third color image data Rd, Gd and Bd with each other to extract the first image data DI1 having the lowest gray scale value and the second and third image data DI2 and DI3 having the gray scale value equal to or larger than the grayscale value of the first image data DI1 (S10).

In an exemplary embodiment, the first, second and third color image data Rd, Gd and Bd shown in FIGS. 5A to 5E may be extracted as the first, second and third image data DI1, DI2 and DI3, respectively, as shown in FIGS. 6A to 6E.

Figure 5A:
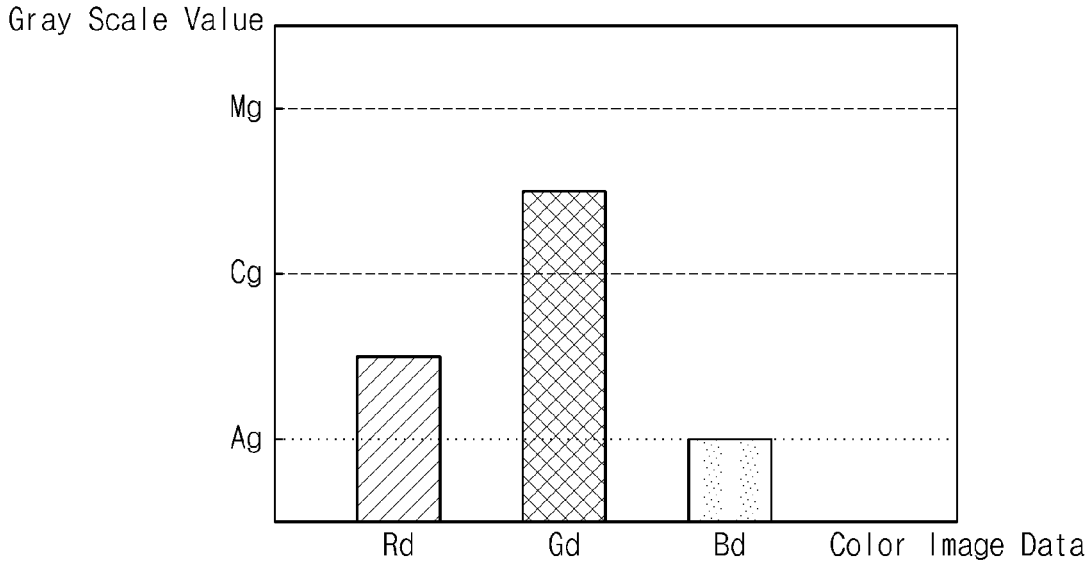
FIGS. 5A to 5E are graphs showing gray scale values of first, second and third color image data.
Figure 6A:
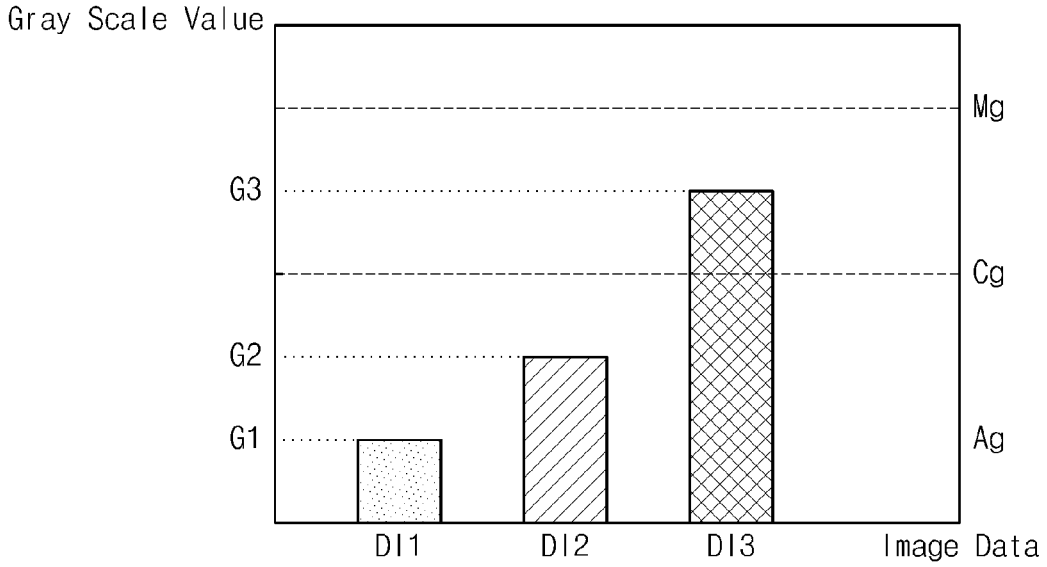
FIGS. 6A to 6E are graphs showing gray scale values of first, second and third image data extracted from the first, second and third color image data, respectively, shown in FIGS. 5A to 5E.

As shown in FIGS. 5A and 6A, the third color image data Bd has the lowest gray scale value Ag, and thus the third color image data Bd may be extracted as the first image data DI1. The first color image data Rd and the second color image data Gd are extracted as the second image data DI2 and the third image data DI3, respectively. The first image data DI1 includes the color information and the gray scale information of the third color image data Bd. The second image data DI2 includes the color information and the gray scale information of the first color image data Rd and the third image data DI3 includes the color information and the gray scale information of the second color image data Gd.

When two or more color image data have the lowest gray scale value Ag, the image data comparator 200 extracts one of the two or more color image data as the first image data DI1.

Figure 5B:
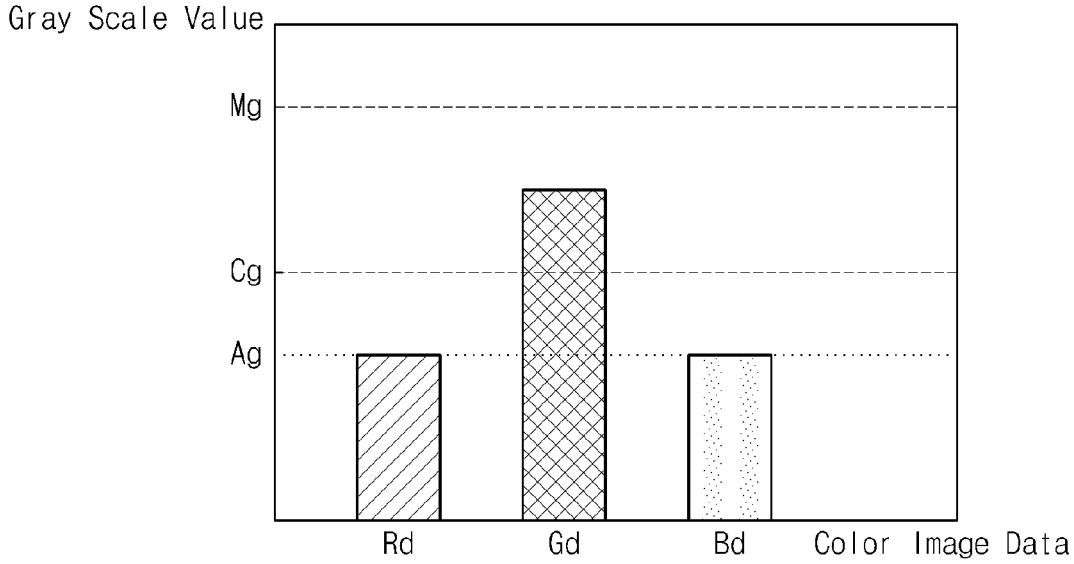
Figure 6B:
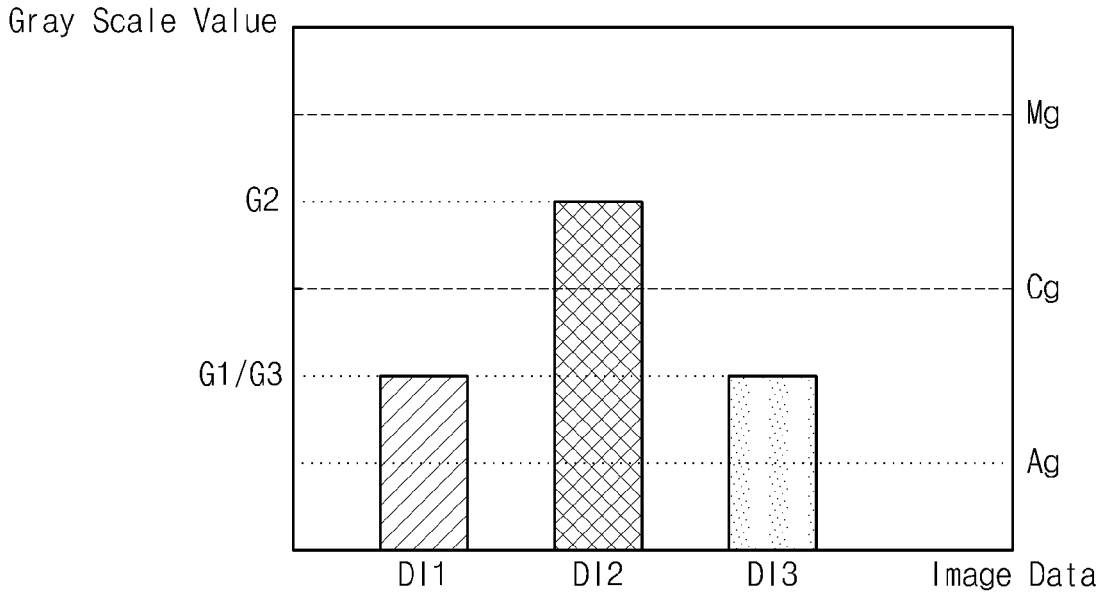

Referring to FIGS. 5B and 6B, when the first and third color image data Rd and Bd have the same gray scale value smaller than the gray scale value of the second color image data Gd, the first color image data Rd may be extracted as the first image data DI1, the second color image data Gd is extracted as the second image data DI2, and the third color image data Bd is extracted as the third image data DI3.

Figure 5C:
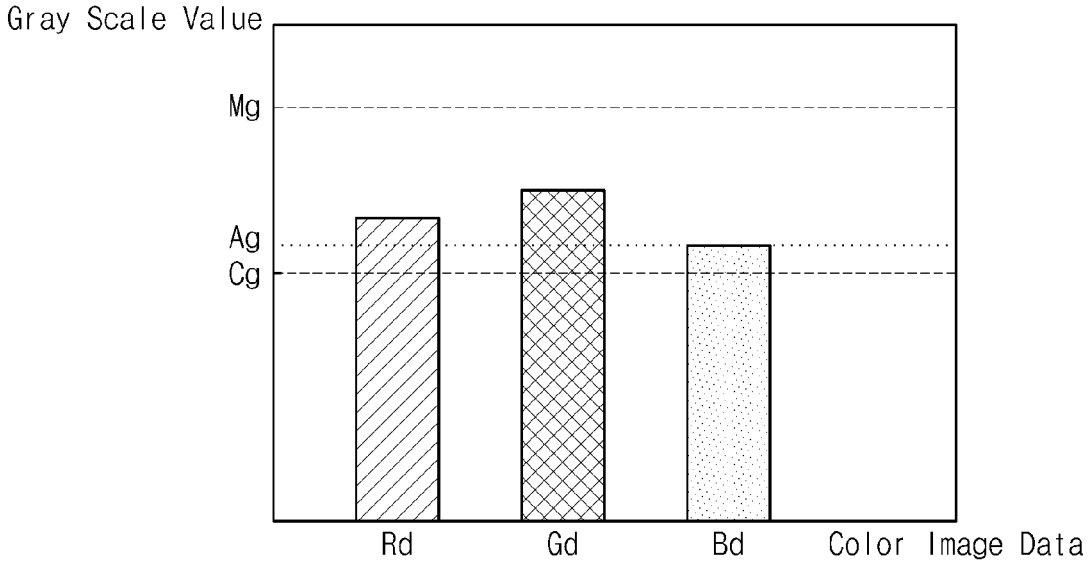
Figure 5D:
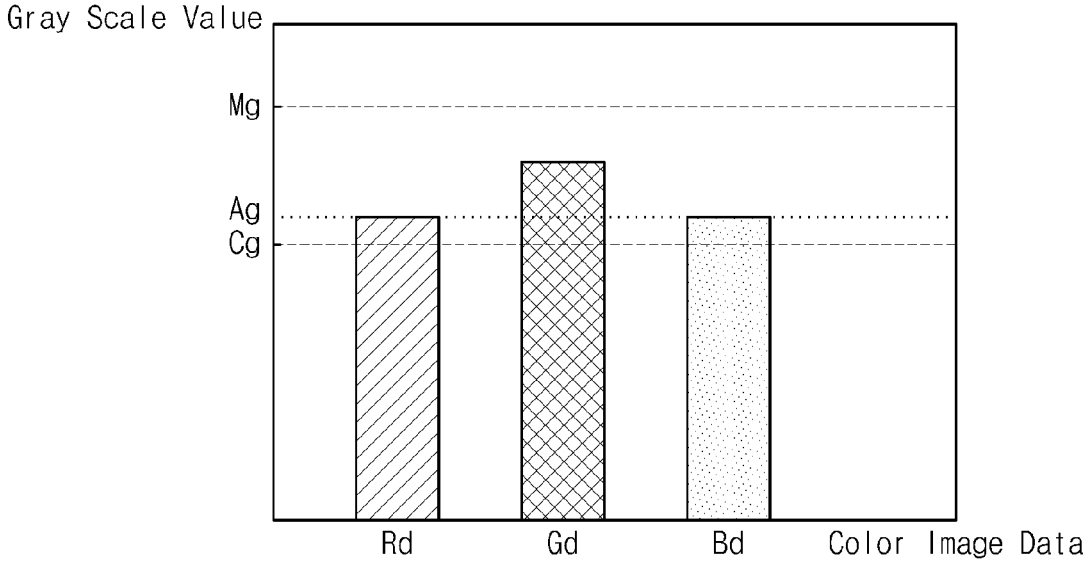
Figure 5E:
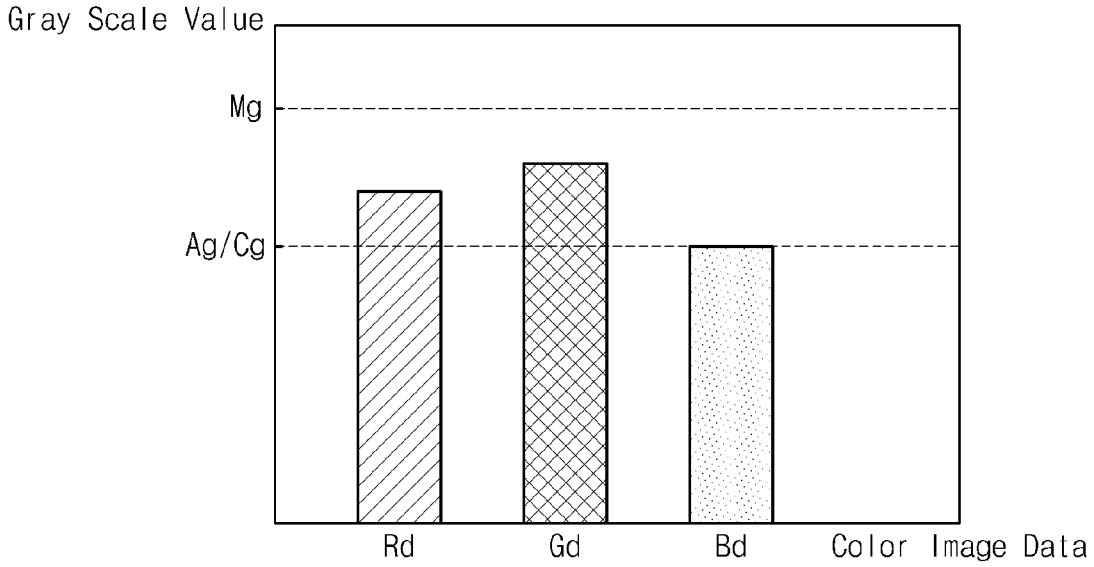
Figure 6C:
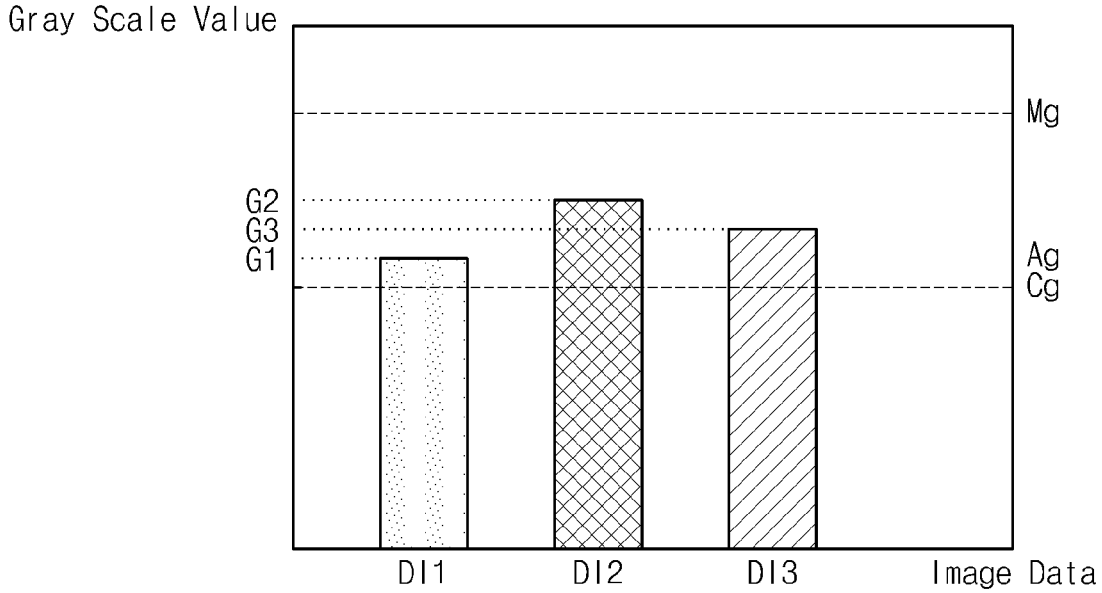
Figure 6D:
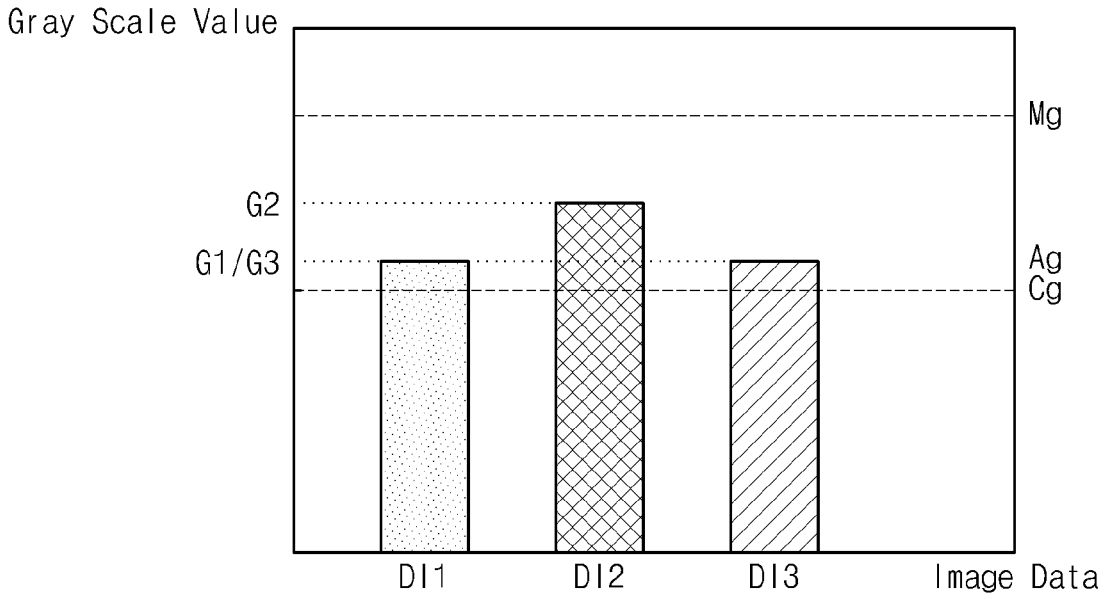
Figure 6E:
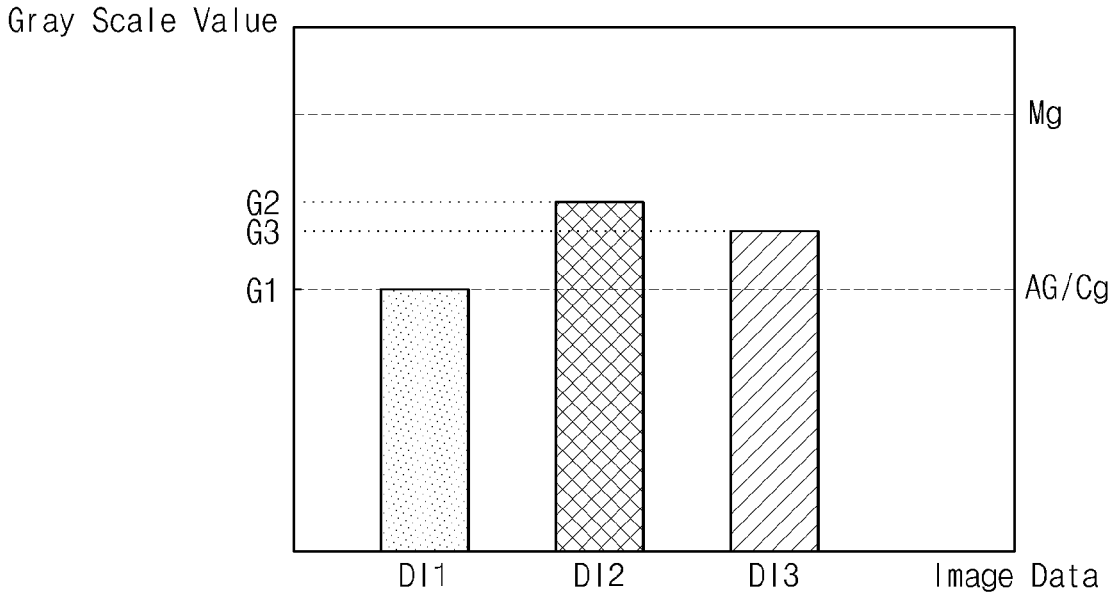

When the first, second and third color image data Rd, Gd and Bd shown in FIGS. 5C to 5E are extracted as the first, second and third image data DI1, DI2 and DI3, respectively, the third color image data Bd may be extracted as the first image data DI1 as shown in FIGS. 6C to 6E. The image data comparator 200 may extract the color image data having the highest gray scale value of the first, second and third color image data Rd, Gd and Bd as the second image data DI2.

When the first image data DI1 is extracted, the image data comparator 200 compares the gray scale value G1 of the first image data DI1 with the predetermined gray scale Cg (S20). After the compared result of the gray scale value G1 of the first image data DI1 and the predetermined gray scale Cg is obtained, the image data comparator 200 outputs the first, second and third image data DI1, DI2 and DI3 and the comparison result data DG.

The predetermined gray scale value Cg is obtained by multiplying a maximum gray scale Mg of the pixel image data by a ratio of a maximum reflectance of the first sub-pixel SPX1 to a maximum reflectance of the pixel PX. The maximum reflectance of the pixel PX is a reflectance when the first, second and third sub-pixels SPX1, SPX2 and SPX3 display the white color. The maximum reflectance of the first sub-pixel SPX1 is a reflectance when the first sub-pixel SPX1 displays the white color while the second and third sub-pixels SPX2 and SPX3 do not reflect the light. In one exemplary embodiment, for example, the maximum reflectance of the pixel PX is 100 and the maximum reflectance of the first sub-pixel SPX1 is 50, and the predetermined gray scale is 128 with respect to the maximum gray scale value of 256.

As shown in FIGS. 5A, 5B, 6A and 6B, when the gray scale value G1 of the first image data DI1 is smaller than the predetermined gray scale value Cg, the gray scale signal GV1 is generated based on the first image data DI1 as shown in FIG. 4 (S30).

For convenience of explanation, the gray scale signal GV1 generated when the gray scale value G1 of the first image data DI1 is smaller than the predetermined gray scale value Cg is referred to as a first gray scale signal GV1. As described above, the first gray scale signal GV1 is generated by the data driver 330 based on the gray scale data GD.

The first gray scale signal GV1 may be a pulse signal maintained at the high period for a predetermined time period. In an exemplary embodiment, the data driver 330 generates the first gray scale signal GV1 with a pulse width modulation method. The pulse width of the first gray scale signal GV1 is determined based on the ratio of the gray scale value G1 of the first image data DI1 with respect to the predetermined gray scale value Cg. When the gray scale value G1 of the first image data DI1 is ⅓ times smaller than the predetermined gray scale value Cg, the first gray scale signal GV1 has the pulse width corresponding to ⅓ time period of a unit frame.

In an exemplary embodiment, the pulse width of the first gray scale signal GV1 may be manipulated based on the gray scale displayed in the first sub-pixel SPX1. In such an embodiment, when the first sub-pixel SPX1 displays eight gray scales from zero (0) gray scale to seven (7) gray scale, the first gray scale signal GV1 has the pulse width corresponding to ⅐ time period of the unit frame when the gray scale value G1 of the first image data DI1 is ⅐ times smaller than the predetermined gray scale value Cg. When the gray scale value G1 of the first image data DI1 is ⅔ times smaller than the predetermined gray scale value Cg, the first gray scale signal GV1 has the pulse width corresponding to ⅔ time period of the unit frame. When the gray scale value G1 of the first image data DI1 is in range between ⅐ and ⅔ of the predetermined gray scale value Cg, the first gray scale signal GV1 may have the pulse width corresponding to ⅔ time period of the unit frame.

When the first gray scale signal GV1 is generated, the first color signal CV1 and the second color signal CV2 are generated based on the second and third image data DI2 and DI3 as shown in FIG. 4 (S40).

As described with reference to FIGS. 1 and 2, the data driver 330 generates the first color signal CV1 and the second color signal CV2 based on the first color data CD1 and the second color data CD2.

The first color data CD1 includes the color information of the second image data DI2 and the information of the ratio of the gray scale value G2 of the second image data DI2 with respect to the maximum gray scale value Mg. The second color data CD2 includes the color information of the third image data DI3 and the information of the ratio of the gray scale value G3 of the third image data DI3 with respect to the maximum gray scale value Mg. In such an embodiment, the first color signal CV1 is generated based on the second image data DI2 and the second color signal CV2 is generated based on the third image data DI3.

The first color signal CV1 may include a first color voltage having first color information or a black voltage having black information, and the second color signal CV2 may include a second color voltage having second color information or a black voltage having black information.

As shown in FIG. 6A, when the second image data DI2 includes red color information and the gray scale value G2 smaller than the maximum gray scale Mg, the first color signal CV1 includes the red color voltage and the black voltage. As described with reference to FIGS. 3A and 3B, the red color voltage is the data voltage for the photonic crystal particles to arrange to thereby reflect light in the red wavelength, and the black voltage is the data voltage for the photonic crystal particles to arrange to thereby transmit the light incident thereto. In such an embodiment, the first color signal CV1 includes two data voltages having different voltage levels from each other.

Referring to FIG. 6A, when the third image data DI3 includes green color information and the gray scale value G3 smaller than the maximum gray scale Mg, the second color signal CV2 includes the green color voltage and the black voltage. When the gray scale value G3 of the third image data DI3 is the same as the maximum gray scale value Mg, the second color signal CV2 does not include the black voltage.

Referring to FIG. 6B, when the gray scale value G1 of the first image data DI1 is equal to the gray scale value G3 of the third image data DI3, the first color signal CV1 is the same as the second color signal CV2. In such an embodiment, the first color signal CV1 and the second color signal CV2 may include the same color voltage and the same black voltage. Each of the first color signal CV1 and the second color signal CV2 may include the green color voltage and the black voltage based on the second image data DI2. When the gray scale value G2 of the second image data DI2 is the same as the maximum gray scale value Mg, each of the first color signal CV1 and the second color signal CV2 includes only the green color voltage.

Then, the pixel PX displays the gray scale and the color as shown in FIG. 4 after the first gray scale signal GV1, the first color signal CV1 and the second color signal CV2 are generated.

The first sub-pixel SPX1 receives the first gray scale signal GV1 and displays the gray scale corresponding to the gray scale information included in the gray scale data GD. The second sub-pixel SPX2 receives the first color signal CV1 displays the first color corresponding to the first color information or the black color, and the third sub-pixel SPX3 receives the second color signal CV2 displays the second color corresponding to the second color information or the black color.

When the second sub-pixel SPX2 successively displays the first color and the black color, and the time ratio, in which the first color and the black color are displayed, satisfies the following Equation 1.

$$C1t:Bk1t=(G2-G1):(Mg-G2) \quad \text{[Equation 1]}$$

In Equation 1, C1$t$ denotes the time period during which the first color is displayed in the second sub-pixel SPX2, and Bk1$t$ denotes the time period during which the black color is displayed in the second sub-pixel SPX2. G2 is the gray scale value of the second image data DI2, G1 is the gray scale value of the first image data DI1, and Mg is the maximum gray scale value.

The second sub-pixel SPX2 successively displays the first color and the black color using Equation 1 to display the gray scale and the color respectively corresponding to the gray scale information and the color information of the second image data DI2.

The data driver 330 applies the first color voltage to the second sub-data line DL1-2 and applies the black voltage to the second sub-data line DL1-2 after a predetermined period of time has lapsed.

The third sub-pixel SPX3 successively displays the second color and the black color, and the time ratio, in which the second color and the black color are displayed, satisfies the following Equation 2.

$$C2t:Bk2t=(G3-G1):(Mg-G3) \quad \text{[Equation 2]}$$

In Equation 2, C2$t$ denotes the time period during which the second color is displayed in the third sub-pixel SPX3, and Bk2$t$ denotes the time period during which the black color is displayed in the third sub-pixel SPX3. When the third sub-pixel SPX3 successively displays the second color and the black color using Equation 2, the third sub-pixel SPX3 may display the gray scale and the color respectively corresponding to the gray scale information and the color information of the third image data DI3.

Hereinafter, an exemplary embodiment of the driving method of the display apparatus, where the gray scale value G1 of the first image data DI1 is equal to or larger than the predetermined gray scale value Cg, will be described with reference to FIG. 4.

The image data comparator 200 may extract the color image data having the highest gray scale value of the first, second and third color image data Rd, Gd and Bd as the second image data DI2. Hereinafter, an exemplary embodiment of the driving method of the display apparatus, where the second image data DI2 has the highest gray scale value among the first, second and third image data DI1, DI2 and DI3, will be described on the assumption that.

Referring to FIGS. 5C to 5E and 6C to 6E, when the gray scale value G1 of the first image data DI1 is equal to or larger than the predetermined gray scale value Cg, the gray scale signal GV2 is generated to allow the first sub-pixel SPX1 to display the gray scale (e.g., a white gray scale) having the maximum reflectance (S50). For convenience of explanation, the gray scale signal that allows the first sub-pixel SPX1 to display the white gray scale is referred to as a second gray scale signal GV2.

The data driver 330 receives the gray scale data GD including the information of the white gray scale and generates the second gray scale signal GV2 based on the gray scale data GD. The second gray scale signal GV2 may be a pulse signal maintained at the high state during a unit frame.

When the second gray scale signal GV2 is generated, the first color signal CV1' and the second color signal CV2' are generated based on the first, second and third image data DI1, DI2 and DI3, as shown in FIGS. 1 and 4.

The timing controller 310 receives the first, second and third image data DI1, DI2 and DI3, generates the first color data CD1 based on the first and second image data DI1 and DI2 and generates the second color data CD2 based on the third image data DI3.

The first color data CD1 includes information about an intermediate color obtained by mixing the color of the color information of the first image data DI1 and the color of the color information of the second image data DI2. The first color data CD1 further includes the color information equal to the color information of the second image data DI2 having the gray scale value larger than the gray scale value of the first image data DI1. The first color data CD1 includes information about a ratio between a value obtained by subtracting the predetermined gray scale value Cg from the gray scale value G1 of the first image data DI1 and a value obtained by subtracting the gray scale value G1 of the first image data DI1 from the gray scale value G2 of the second image data DI2.

The second color data CD2 includes color information equal to the color information of the third image data D13. The second color data CD2 includes information about a ratio between a value obtained by subtracting the predetermined gray scale Cg from the gray scale value G2 of the second image data DI2 and a value obtained by the gray scale value G3 of the third image data DI3 from the gray scale value G2 of the second image data DI2.

The data driver 330 receives the first and second color data CD1 and CD2 including the above-mentioned information and generates the first and second color signals CV1 and CV2 based on the first and second color data CD 1 and CD2. In such an embodiment, the first color signal CV1 is based on the first and second image data DI1 and DI2 and the second color signal CV2 is based on the third image data DI3.

The first color signal CV1' may include the first color voltage having the first color information or the second color voltage having the second color information. The first color information is related to the intermediate color in which the color of the color information of the first image data DI1 is mixed with the color of the color information of the second image data DI2, and the second color information is the color information of the second image data DI2.

The second color signal CV2 may include the third color voltage having the third color information or the black voltage having the black information. The third color information is the color information of the third image data DI3.

As shown in FIGS. 6C and 6D, in an exemplary embodiment where the first image data DI1 includes blue color information and the gray scale value larger than the predetermined gray scale value Cg and the second image data DI2 includes green color information and the gray scale value larger than the gray scale value G1 of the first image data DI1, the first color signal CV1 includes a cyan color voltage having cyan color information obtained by mixing the blue color with the green color and a green color voltage having the green color information. The second color signal CV2 includes the red color voltage having the red color information and the black voltage having the black information.

In an exemplary embodiment, as shown in FIG. 6E, when the first image data DI1 has the gray scale value G1 equal to the predetermined gray scale Cg, the first color signal CV1 includes the green color voltage having the green color information. The second color signal CV2 includes the red color voltage having the red color information and the black voltage having the black information.

When the second gray scale signal GV2, the first color signal CV1, and the second color signal CV2 are generated, the pixel PX displays the gray scale and the color, as shown in FIG. 4 (S70).

The first sub-pixel SPX1 receives the second gray scale signal GV2 and displays the white gray scale, and the second sub-pixel SPX2 receives the first color signal CV1 and displays the first color corresponding to the first color information or the second color corresponding to the second color information, and the third sub-pixel SPX3 receives the second color signal CV2' and displays the third color corresponding to the third color information or the black color.

The second sub-pixel SPX2 successively displays the first color and the second color and the time ratio, in which the first color and the second color are displayed, satisfies the following Equation 3.

$$C3t:C4t=(G1-Cg):(G2-G1) \quad \text{[Equation 3]}$$

In Equation 3, C3*t* denotes the time period during which the first color is displayed in the second sub-pixel SPX2, and C4*t* denotes the time period during which the second color is displayed in the second sub-pixel SPX2. The data driver 330 outputs the first color voltage to the second sub-data line DL1-2 and then outputs the second color voltage to the second sub-data lien DL1-2 after a predetermined time period has lapsed.

In an exemplary embodiment where the extracted image data are the data shown in FIGS. 6C and 6D, the data driver 330 may output the cyan color voltage having the cyan color information to the second sub-data line DL1-2 and output the green color voltage having the green color information to the second sub-data line DL1-2 after the predetermined time period has lapsed. In such an embodiment, the green color voltage may be output to the second sub-data line DL1-2 after the time period of H×(G1−Cg)/(G2−Cg) in the H time period.

In such an embodiment, the third sub-pixel SPX3 successively displays the third color and the black color and the time ratio, in which the third color and the black color are displayed, satisfies the following Equation 4. Equation 4 shows the information of a ratio between a value obtained by subtracting the predetermined gray scale value Cg from the gray scale value G2 of the second image data DI2 and a value obtained by subtracting the gray scale value G3 of the third image data DI3 from the gray scale value G2 of the second image data DI2.

$$C5t:C6t=(G3-Cg):(G2-G3) \quad \text{[Equation 4]}$$

In Equation 4, C5*t* denotes the time period during which the third color is displayed in the third sub-pixel SPX3, and C6*t* denotes the time period during which the black color is displayed in the third sub-pixel SPX3. The data driver 330 outputs the red color voltage to the third sub-data line DL1-3. In such an embodiment, the black color voltage may be output to the third sub-data line DL1-3 after the time period of H×(G3−Cg)/(G2−G3) in the H time period.

As shown in FIG. 6E, when the gray scale value G1 of the first image data DI1 is equal to the predetermined gray scale value Cg, the second sub-pixel SPX2 displays only one color. In an exemplary embodiment, the data driver 330 may output the green color voltage to the second sub-data line DL1-2.

Figure 7:
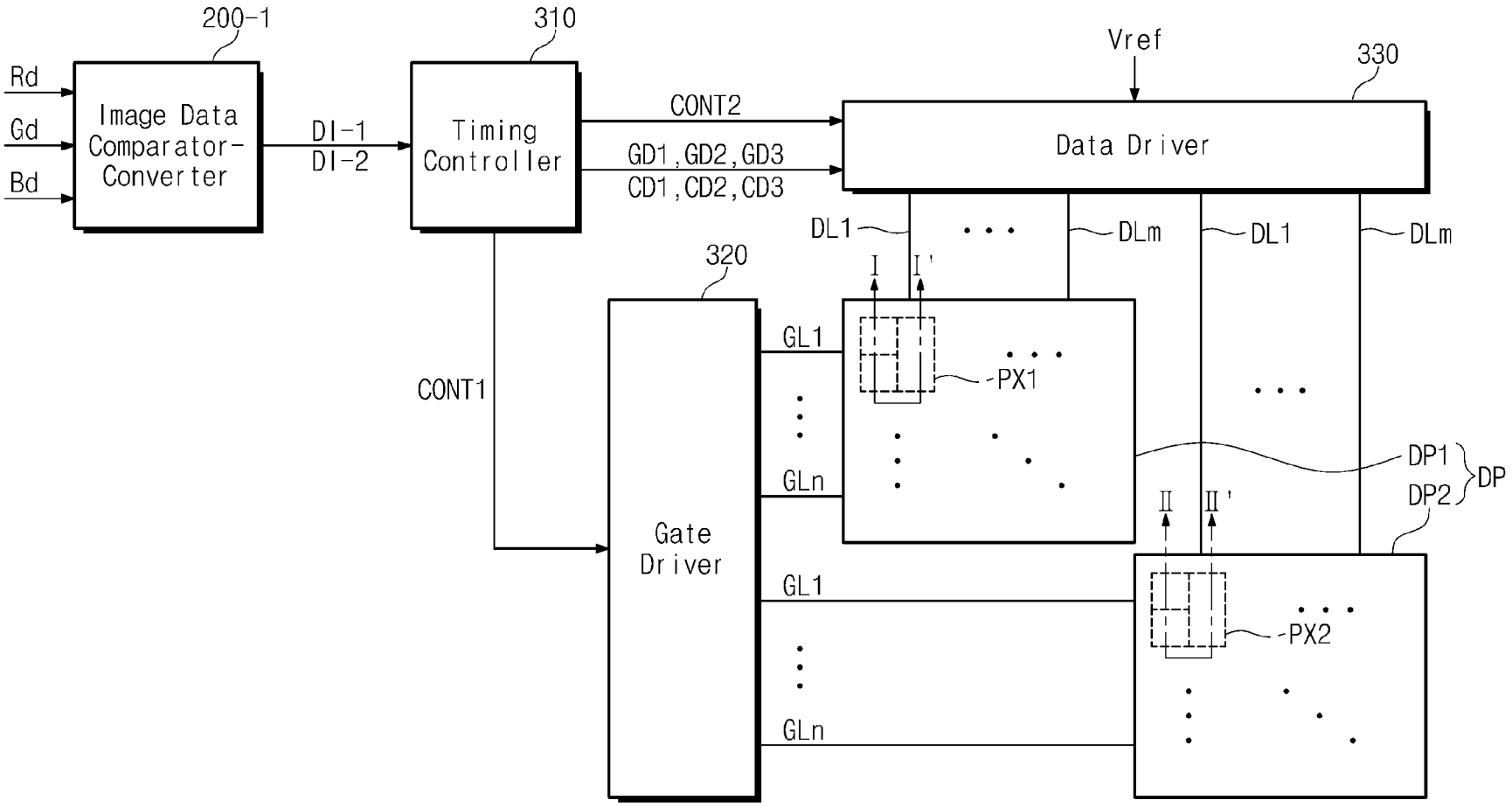
FIG. 7 is a block diagram showing an alternative exemplary embodiment of a display apparatus according to the invention.
Figure 8A:
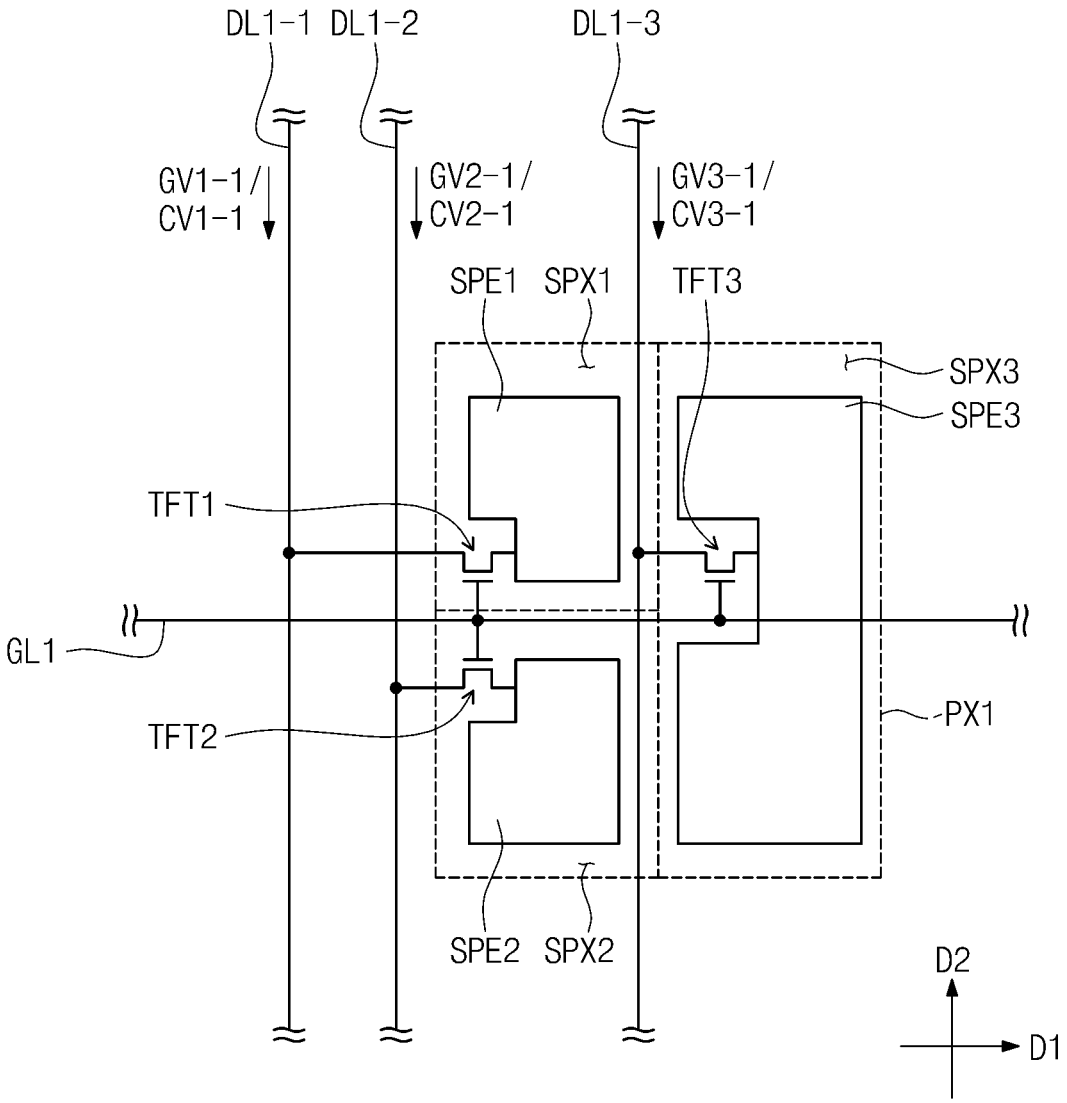
FIGS. 8A and 8B are block diagrams respectively showing first and second pixels shown in FIG. 7.
Figure 8B:
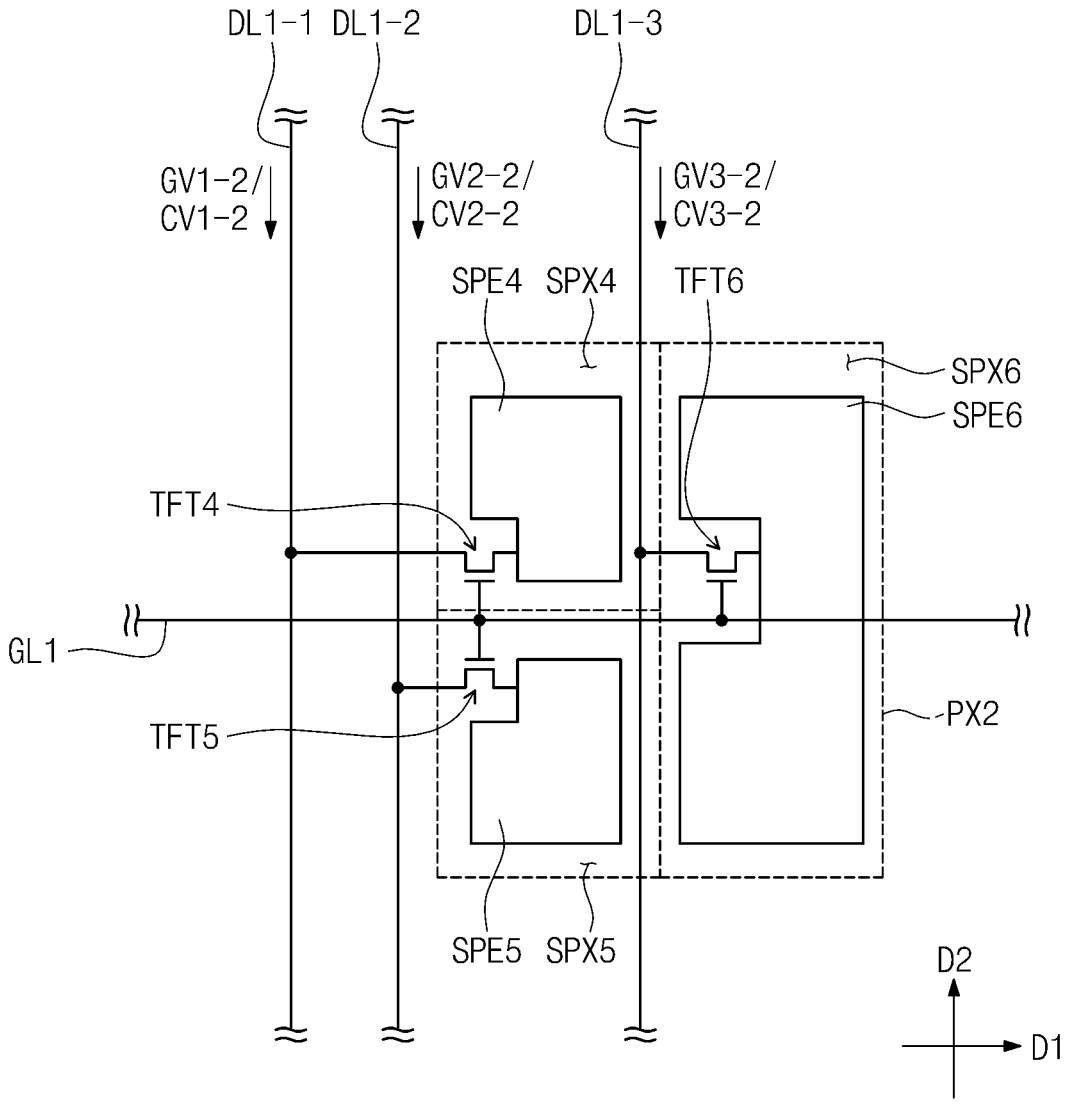
Figure 9:
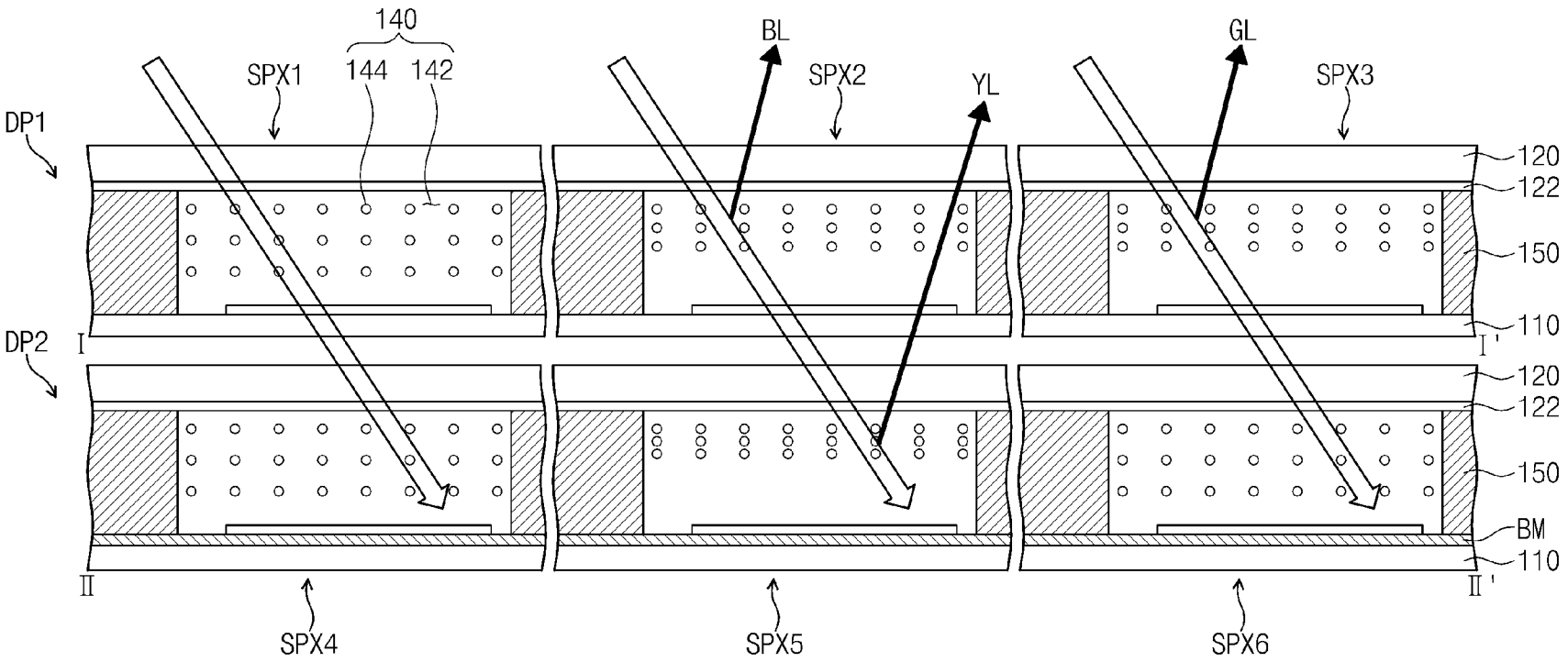
FIG. 9 is a cross-sectional view taken along line I-I' and line II-II shown in FIG. 7, respectively showing the first and second pixels.

FIG. 7 is a block diagram showing an alternative exemplary embodiment of a display apparatus according to the invention, FIGS. 8A and 8B are block diagrams respectively showing first and second pixels shown in FIG. 7. FIG. 9 is a cross-sectional view taken along line I-I' and line II-II shown in FIG. 7 respectively showing the first and second pixels. The same or like elements shown in FIGS. 7, 8A, 8B and 9 have been labeled with the same reference characters as used above to describe the exemplary embodiments of the display apparatus shown in FIGS. 1 to 6, and any repetitive detailed description thereof will hereinafter be omitted or simplified.

Referring to FIGS. 7 to 9, a display apparatus includes an image data comparator-converter 200-1, a driving circuit and a display panel DP.

The display panel DP includes an upper display panel DP1 including a first pixel PX1, in which a plurality of sub-pixels is disposed, and a lower display panel DP2 including a second pixel PX2, in which a plurality of sub-pixels is disposed. In one exemplary embodiment, for example, the first pixel PX1 includes first, second and third sub-pixels SPX1, SPX2 and SPX3, and the second pixel PX2 includes fourth, fifth and sixth sub-pixels SPX4, SPX5 and SPX6.

The lower display panel DP2 is disposed under the upper display panel DP1 such that the fourth, fifth and sixth sub-pixels SPX4, SPX5 and SPX6 of the second pixel PX2 correspond to the first, second and third sub-pixels SPX1, SPX2 and SPX3 of the first pixel PX1, respectively.

When the first sub-pixel SPX1 has an area substantially equal to an area of the second sub-pixel SPX2 and the third sub-pixel SPX3 has an area twice larger than an area of the second sub-pixel SPX2, the fourth sub-pixel SPX4 has an area substantially equal to an area of the fifth sub-pixel SPX5 and the sixth sub-pixel SPX6 has the area twice larger than the fifth sub-pixel SPX5.

The upper display panel DP1 may have a structure and configuration the substantially same as a structure and configuration of the lower display panel DP2. Each of the upper and lower display panels DP1 and DP2 includes a first substrate 110 and a second substrate 120 facing and spaced apart from the first substrate 110. The first substrate 110 includes a plurality of first lines GL1 to GLn extending in a first direction D1 and a plurality of second lines DL1 to DLm extending in a second direction D2 crossing the first direction D1. The second lines DL1 to DLm are electrically insulated from the first lines GL1 to GLn. Each of the second lines DL1 to DLm includes a first sub-line DL1-1, a second sub-line DL1-2 and a third sub-line DL1-3. The first, second, and third sub-lines DL1-1, DL1-2 and DL1-3 are electrically insulated from each other.

In an exemplary embodiment, the second substrate 120 includes a common electrode 122 disposed on a surface thereof facing the first substrate 110.

The first, second and third sub-pixels SPX1, SPX2 and SPX3 are disposed on the first substrate 110 and respectively include first, second and third sub-pixel electrodes SPE1, SPE2 and SPE3 and first, second and third thin film transistors TFT1, TFT2 and TFT3. The fourth, fifth and sixth sub-pixels SPX4, SPX5 and SPX6 respectively include fourth, fifth and sixth sub-pixel electrodes SPE4, SPE5 and SPE6, and fourth, fifth and sixth thin film transistors TFT4, TFT5 and TFT6.

The first, second and third thin film transistors TFT1, TFT2 and TFT3 are respectively connected to the first, second and third sub-lines DL1-1, DL1-2 and DL1-3 (hereinafter, referred to as first, second and third sub-data lines) and respectively connected to the first, second and third sub-pixel electrodes SPE1, SPE2 and SPE3. In an exemplary embodiment, the first, second and third thin film transistors TFT1, TFT2 and TFT3 are connected to one of the first lines GL1 to GLn (e.g., a first gate line GL1). In the illustrated exemplary embodiment, the fourth, fifth and sixth sub-pixels SPX4, SPX5 and SPX6 have the same structure and function as the structure and function of the first, second and third sub-pixels SPX1, SPX2 and SPX3, and detailed descriptions of the fourth, fifth and sixth sub-pixels SPX4, SPX5 and SPX6 will hereinafter be omitted.

As shown in FIG. 9, the lower display panel DP2 may further include a black color layer BM. The black color layer BM may be the protective layer (refer to FIG. 3A) disposed on the first substrate 110 included in the lower display panel DP2 or may be provided as a separate layer.

The first to sixth sub-pixels SPX1 to SPX6 include a photonic crystal material 140. The photonic crystal material 140 includes a dielectric solvent 142 and a plurality of photonic crystal particles 144 dispersed in the dielectric solvent 142.

In an exemplary embodiment, as shown in FIG. 9, the upper display panel DP1 is spaced apart from the lower display panel DP2, but not being limited thereto. In an alternative exemplary embodiment, the first substrate 110 of the upper display panel DP1 may be attached to the second substrate 120 of the lower substrate DP2. In another alternative exemplary embodiment, either the first substrate 110 of the upper display panel DP1 or the second substrate 120 of the lower display panel DP2 may be omitted from the display panel DP. In one exemplary embodiment, for example, the second substrate 120 of the lower display panel DP2 is omitted, and the common electrode 122 of the lower display panel DP2 is disposed on a lower surface of the first substrate 110 of the upper display panel DP1.

Hereinafter, an exemplary embodiment of a method of displaying a gray scale and a color image on the display panel DP will be described in detail with reference to FIG. 9.

When the driving voltage is applied to the photonic crystal material 140, the photonic crystal material 140 is realigned, and the gray scale or the color image is thereby displayed. The driving signal may be substantially simultaneously applied to the photonic crystal material 140 included in the upper display panel DP1 and the photonic crystal material 140 included in the lower display panel DP2.

The pixel voltage is applied to the first, second and third sub-pixel electrodes SPE1, SPE2 and SPE3, and the common voltage is applied to the common electrode 122 disposed on the upper display panel DP1 when the driving voltage is applied to the photonic crystal material 140 included in the upper display panel DP1. The pixel voltage is charged in the first, second and third sub-pixel electrodes SPE1, SPE2 and SPE3 through the first, second and third thin film transistors TFT 1, TFT2 and TFT3 as the data voltage.

In an exemplary embodiment, the photonic crystal particles 144 may have the positive (+) polarity. When the level of the common voltage is lower than the level of the pixel voltage, the driving voltage has the positive (+) polarity, and the driving voltage has the negative (−) polarity when the level of the common voltage is higher than the level of the pixel voltage. In an exemplary embodiment, the level of the common voltage is constant, and the level of the pixel voltage may be swung with reference to the level of the common voltage to change the polarity of the driving voltage.

Each of the first to sixth sub-pixels SPX1 to SPX6 transmits the light incident thereto or reflects the specific wavelength of the light.

In an exemplary embodiment, the first sub-pixel SPX1 and the fourth sub-pixel SPX4 operate complementary to each other to display the gray scale or the color image through the display panel DP. In such an embodiment, the first sub-pixel SPX1 and the second sub-pixel SPX4 are related to each other to display one color. The one color indicates not only the white or black color but also the other colors. The color generated by the first sub-pixel SPX1 and the fourth sub-pixel SPX4, which operate complementary to each other, is displayed in an area corresponding to the first sub-pixel SPX1.

The second sub-pixel SPX2 and the fifth sub-pixel SPX5 operate complementary to each other, and the third sub-pixel SPX3 and the sixth sub-pixel SPX6 operates complementary to each other.

As shown in FIG. 9, the first sub-pixel SPX1 and the fourth sub-pixel SPX4 may transmit the light incident thereto to display the black color in the area corresponding to the first sub-pixel SPX1. Due to the black color layer BM, the black color is displayed in the area corresponding to the first sub-pixel SPX1.

The second sub-pixel SPX2 may reflect light BL in the blue wavelength when the light is incident thereto, and the fifth sub-pixel SPX5 reflects the light YL in a yellow wavelength when the light is incident thereto to display the white color in the area corresponding to the second sub-pixel SPX2. The light BL in the blue wavelength is mixed with the light YL in the yellow wavelength in the area corresponding to the second sub-pixel SPX2 such that the white color is displayed in the area corresponding to the second sub-pixel SPX2.

In an exemplary embodiment, the white color is obtained by mixing the light BL in the blue wavelength with the light YL in the yellow wavelength, but not being limited thereto. In an alternative exemplary embodiment, the second sub-pixel SPX2 and the fifth sub-pixel SPX5 may reflect the light having two different wavelengths, which displays the white color by being mixed with each other.

The color obtained by mixing the light reflected by the second sub-pixel SPX2 with the light reflected by the fifth sub-pixel SPX5 may be displayed in the area corresponding to the second sub-pixel SPX2. In an exemplary embodiment, when the second sub-pixel SPX2 reflects the light in the green wavelength and the fifth sub-pixel SPX5 reflects the light in the blue wavelength, the cyan color may be displayed in the area corresponding to the second sub-pixel SPX2.

The third sub-pixel SPX3 reflects the light GL in the green wavelength when light is incident thereto, and the sixth sub-pixel SPX6 transmits the light incident thereto, such that the green color is displayed in the area corresponding to the third sub-pixel SPX3.

Hereinafter, the image data comparator-converter 200-1, the timing controller 310, the gate driver 320 and the data driver 330 will be described in detail with reference to FIG. 7.

The image data comparator-converter 200-1 receives a plurality of pixel image data on a frame-by-frame basis. A pixel image data has information of the light displayed by a pixel. The pixel image data includes a first color image data Rd, a second color image data Gd and a third color image data Bd.

The first, second and third color image data Rd, Gd and Bd include red information, green information and blue information, respectively. Each of the first, second and third color image data Rd, Gd and Bd include gray scale information.

The image data comparator-converter 200-1 compares gray scale values of the first, second and third color image data Rd, Gd and Bd with each other. The image data comparator-converter 200-1 generates a first image data DI-1 or a second image data DI-2 based on the compared result of the gray scale values of the first, second and third color image data Rd, Gd and Bd.

When the first, second and third color image data Rd, Gd and Bd have the same gray scale value, the image data comparator-converter 200-1 generates the first image data DI-1 and provides the first image data DI-1 to the timing controller 310. The first image data DI-1 includes information of a ratio between the gray scale values of the first, second and third color image data Rd, G and Bd and the maximum gray scale of the pixel image data.

When the first, second and third color image data Rd, Gd and Bd does not have the same gray scale value, the image data comparator-converter 200-1 generates the second image data DI-2 and provides the second image data DI-2 to the timing controller 310. The second image data DI-1 includes the hue-saturation-intensity-converted ("HSI"-converted) information of the first, second and third color image data Rd, Gd and Bd.

In an exemplary embodiment, the HIS-converted information of the first, second and third color image data Rd, Gd and Bd includes color information, chroma information and brightness information of the image displayed by the complementary operation of the first pixel PX1 and the second pixel PX2. In such an embodiment, the second image data DI-2 includes color data including the color information, chroma data including the chroma information, and the brightness information including brightness data.

The timing controller 310 receives the first image data DI-1 and the second image data DI-2. The timing controller 310 generates three gray scale data GD1, GD2 and GD3 based on the first image data DI-1 and generates three color data CD1, CD2 and CD3 based on the second image data DI-2.

Each of the three gray scale data GD1, GD2 and GD3 includes blue and yellow color information or two black color information, and each of the three color data CD1, CD2 and CD3 includes two color information or one color information and black color information.

In an exemplary embodiment, the timing controller 310 receives various control signals, such as a vertical synchronizing signal, a horizontal synchronizing signal, a main clock and a data enable signal, for example.

The timing controller 310 applies a gate control signal CONT1 to the gate driver 320 based on the various signals. The timing controller 310 applies a data control signal CONT2 to the data driver 330 and provides the three gray scale data GD1, GD2 and GD3 or the three color data CD1, CD2 and CD3.

The gate control signal CONT1 includes a vertical synchronization start signal that indicates the starting of the output of a gate-on pulse (e.g., a gate-on voltage period), a gate clock signal that controls the output timing of the gate-on pulse, and a gate-on enable signal that determines the width of the gate-on pulse.

The data control signal CONT2 includes a horizontal start signal that starts the operation of the data driver 330, an inverting signal and an output indicating signal.

The gate driver 320 sequentially applies the gate voltage to the gate lines GL1 to GLn in response to the gate control signal CONT1.

The data driver 330 receives the three gray scale data GD1, GD2 and GD3 from the timing controller 310. The data driver 330 converts the three gray scale data GD1, GD2 and GD3 into three pairs of gray scale signals, respectively, based on the reference voltage Vref provided from an external device. Each pair of the three pairs of gray scale signals may include two black voltages or blue and yellow voltages.

The black voltage is the data voltage that arranges the photonic crystal particles to transmit the light incident thereto, and the blue voltage is the data voltage that arranges the photonic crystal particles to reflect the light having the wavelength corresponding to blue color when the light is incident thereto.

In an exemplary embodiment, a first gray scale signals GV1-1 and GV1-2 (shown in FIGS. 8A and 8B) of the three pairs of gray scale signals may be applied to the first sub-pixel SPX1 and the fourth sub-pixel SPX4, a second pair of gray scale signals GV2-1 and GV2-2 (shown in FIGS. 8A and 8B) of the three pairs of gray scale signals may be applied to the second sub-pixel SPX2 and fifth sub-pixel SPX5, and a third pair of gray scale signals GV3-1 and GV3-2 (shown in FIGS. 8A and 8B) of the three pairs of gray scale signals may be applied to the third sub-pixel SPX3 and the sixth sub-pixel SPX6.

When the first pair of gray scale signals GV1-1 and GV1-2 are the two black voltages, the first and fourth sub-pixels SPX1 and SPX4 transmit the light incident thereto such that the black color is displayed in an area corresponding to the first sub-pixel SPX1.

When the first pair of gray scale signals GV1-1 and GV1-2 are the blue and yellow voltages, the first sub-pixel SPX1 reflects the light having the wavelength corresponding to blue color and the fourth sub-pixel SPX4 reflects the light having the wavelength corresponding to yellow color such that the white color is displayed in an area corresponding to the first sub-pixel SPX1.

In an exemplary embodiment, the area corresponding to the second and third sub-pixels SPX2 and SPX3 may display the black or white color as the area corresponding to the first sub-pixel SPX1. In such an embodiment, the various gray scales may be displayed in the area corresponding to the first pixel PX1.

The data driver 330 receives the three color data CD1, CD2 and CD3 from the timing controller 310. The data driver 330 converts the three color data CD1, CD2 and CD3 into three pairs of color signals, respectively, based on the reference voltage Vref provided from the exterior. Each pair of the three pairs of color signals may be two color voltages or the color and black voltages. In an exemplary embodiment, the color voltage is the data voltage that allows the photonic crystal material to reflect the light having the specific wavelength when light is incident thereto.

In an exemplary embodiment, a first pair of color signals CV1-1 and CV1-2 (shown in FIGS. 8A and 8B) of the three pairs of color signals may be applied to the first sub-pixel SPX1 and the fourth sub-pixel SPX4. The first and fourth sub-pixels SPX1 and SPX4 reflect the light having the specific wavelength in response to the first pair of color signals CV1-1 and CV1-2. The first sub-pixel SPX1 reflects the light in the blue wavelength and the fourth sub-pixel SPX4 reflects the light in the green wavelength such that the cyan color is displayed in the area corresponding to the first sub-pixel SPX1.

In an exemplary embodiment, the first sub-pixel SPX1 may reflect the light in the blue wavelength and the fourth sub-pixel SPX4 may transmit the light incident thereto such that the blue color is displayed in the first sub-pixel SPX1.

The area corresponding to the second and third sub-pixels SPX2 and SPX3 displays the cyan or blue color as the area corresponding to the first sub-pixel SPX1.

Figure 10:
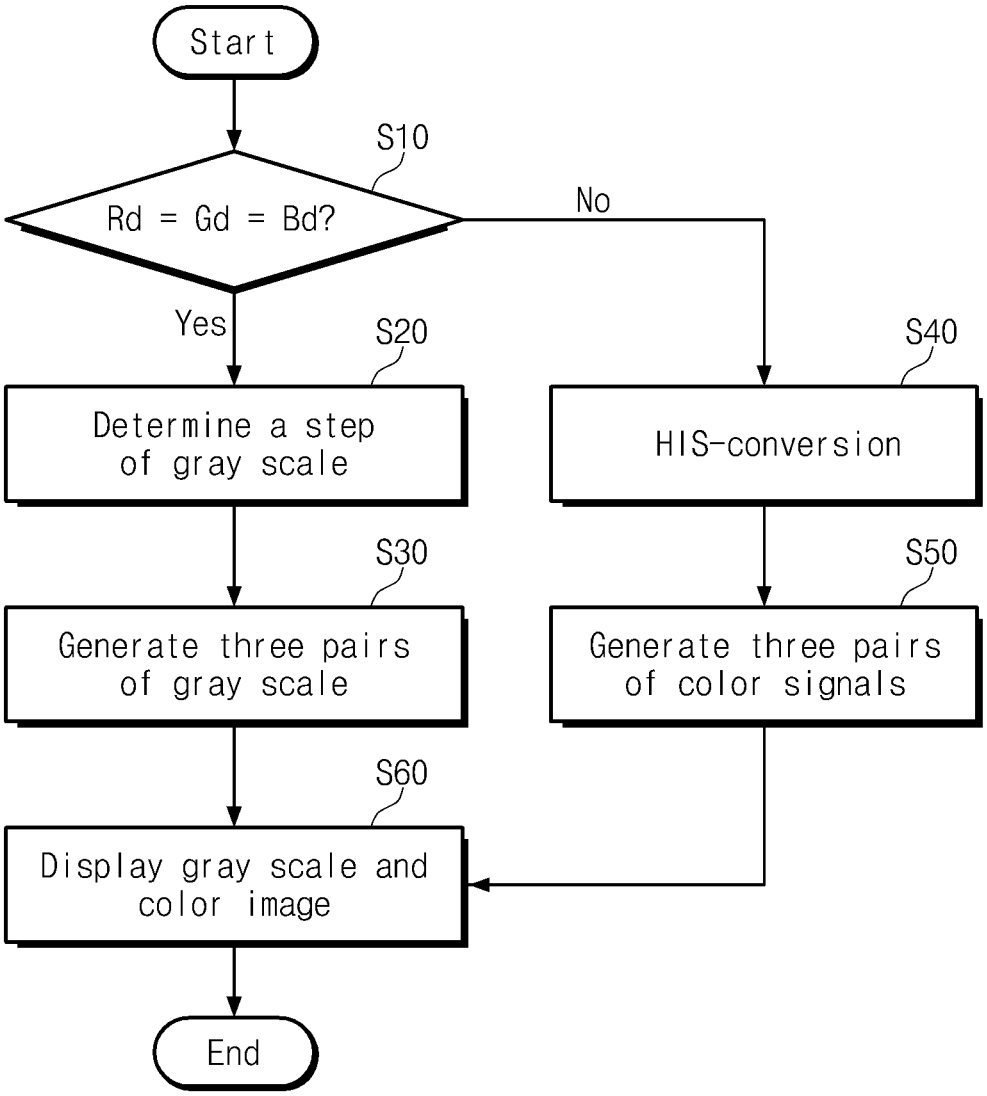
FIG. 10 is a flowchart showing an exemplary embodiment of a driving method of the display apparatus shown in FIG. 7.
Figure 11A:
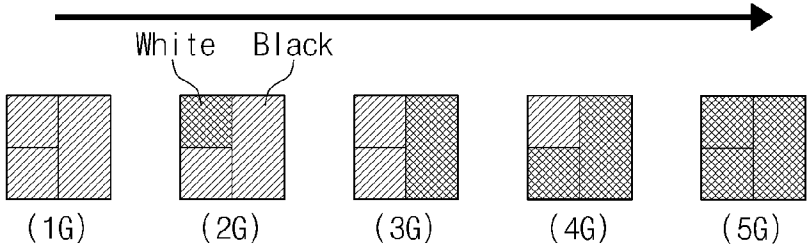
FIGS. 11A and 11B are views showing images displayed through the first and second pixels.
Figure 11B:
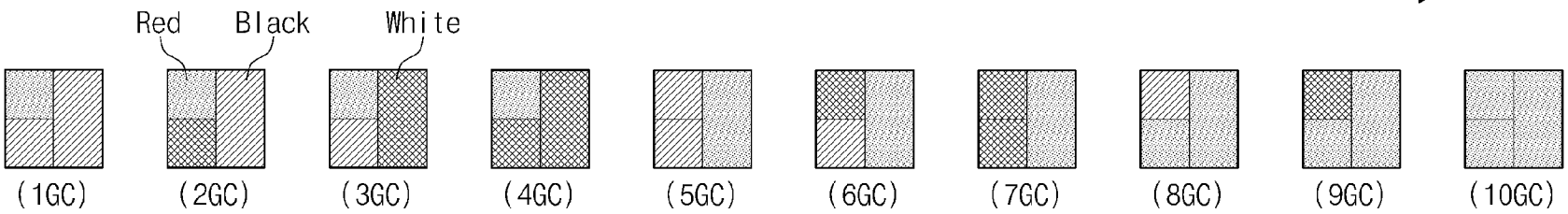
Figure 12A:
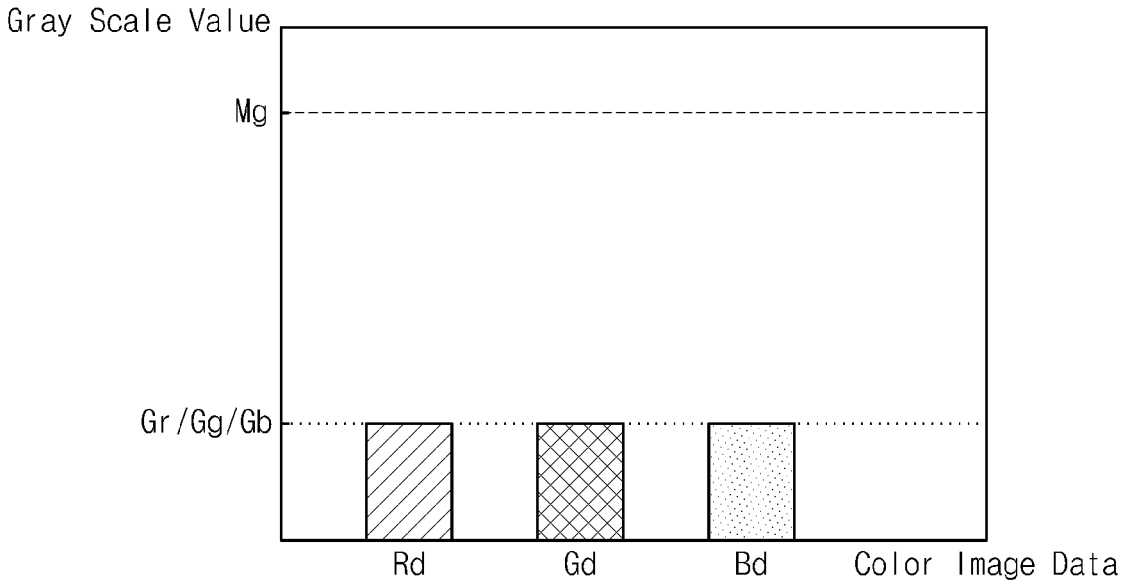
FIGS. 12A and 12B are graphs showing gray scale values of first, second and third color image data.
Figure 12B:
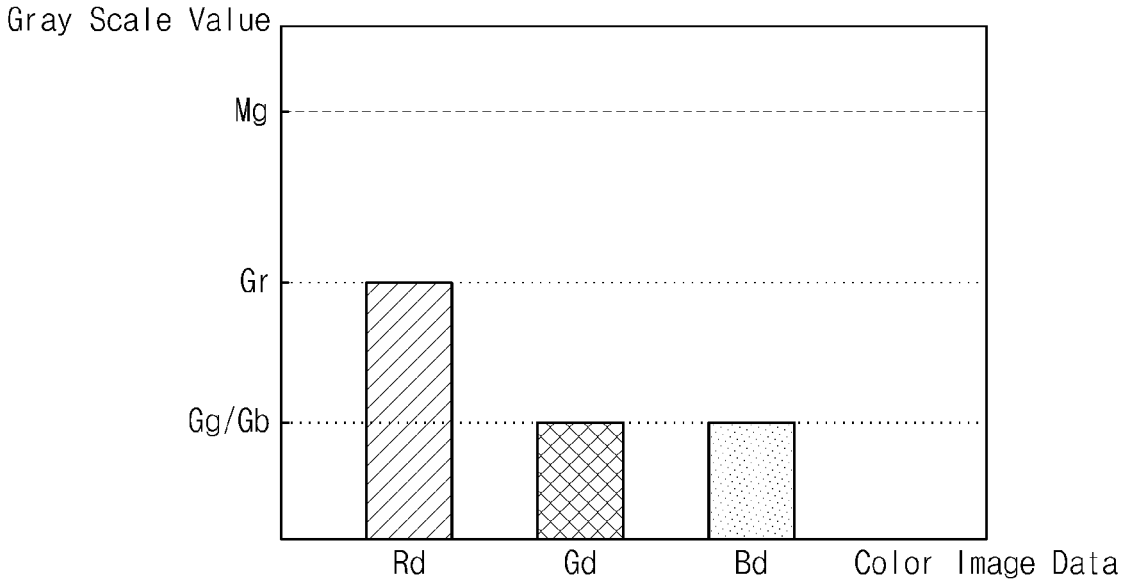
Figure 13:
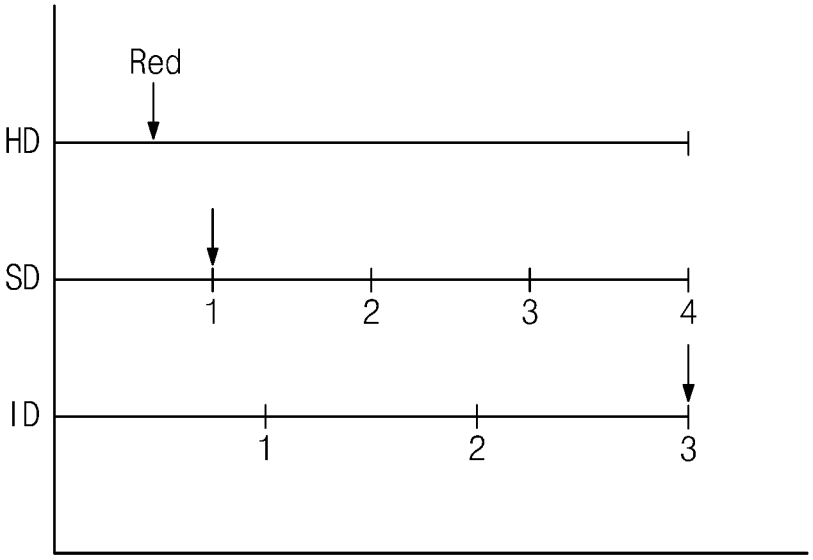
FIG. 13 is a graph showing the first, second and third color image data converted to hue-saturation-intensity ("HSI") values.

FIG. 10 is a flowchart showing an exemplary embodiment of a driving method of the display apparatus shown in FIG. 7, and FIGS. 11A and 11B are views showing images displayed by the first and second pixels. FIGS. 12A and 12B are graphs showing gray scale values of first, second and third color image data, and FIG. 13 is a graph showing the first, second and third color image data converted to HSI values.

Referring to FIG. 10, the gray scale values Gr, Gg and Gb of the first, second and third color image data Rd, Gd and Bd are compared with each other (S10). The image data comparator-converter 200-1 compares the gray scale values Gr, Gg and Gb of the first, second, and third color image data Rd, Gd and Bd with each other.

When the gray scale values Gr, Gg and Gb of the first, second and third color image data Rd, Gd and Bd are the same, the level of the gray scale is determined (S20). As shown in FIG. 11A, the display panel DP may determine the level of the gray scale based on one level in five-level gray scale from a black gray scale 1G to a white gray scale 5G.

Referring to FIG. 12, when the gray scale values Gr, Gg and Gb of the first, second and third color image data Rd, Gd and Bd are the same, the level of the gray scale is determined based on the ratio information of the gray scale values Gr, Gg and Gb of the first, second and third color image data Rd, Gd and Bd with respect to the maximum gray scale value Mg of the pixel image data.

In an exemplary embodiment, when the ratio of the gray scale values Gr, Gg and Gb of the first, second and third color image data Rd, Gd and Bd to the maximum gray scale value Mg of the pixel image data is about ¼, the level of the gray scale is determined to the second gray scale 2G.

In an exemplary embodiment, the level of the gray scale may be determined by rounding the ratio of the gray scale values Gr, Gg and Gb of the first, second and third color image data Rd, Gd and Bd with respect to the maximum gray scale Mg. In an exemplary embodiment, when the ratio of the gray scale values Gr, Gg and Gb of the first, second and third color image data Rd, Gd and Bd to the maximum gray scale value Mg of the pixel image data is about ⅕, the level of the gray scale may be determined to the second gray scale 2G by rounding up. When the ratio of the gray scale values Gr, Gg and Gb of the first, second and third color image data Rd, Gd and Bd to the maximum gray scale value Mg of the pixel image data is about ⅓, the level of the gray scale may be determined to the second gray scale 2G by rounding down.

Then, the three pairs of gray scale signals corresponding to the determined level of the gray scale are generated (S30).

The timing controller 310 generates the three gray scale data GD1, GD2 and GD3 based on the first image data DI-1 and the data driver receives the three gray scale data GD1, GD2 and GD3 to generate the three pairs of gray scale signals.

In such an embodiment, when the ratio of the gray scale values Gr, Gg and Gb of the first, second and third color image data Rd, Gd and Bd is about ¼, the first pair of gray scale data may be the gray scale data including the blue color information and the gray scale data including the yellow color information.

The three pairs of gray scale signals (refer to FIGS. 8A and 8B) are generated based on the three gray scale data GD1, GD2 and GD3. The three pairs of gray scale signals are generated based on the blue color information, the yellow color information, and the black color information of the three gray scale data GD1, GD2 and GD3.

In such an embodiment, the first pair of gray scale signals has the blue color voltage and the yellow color voltage, and each of remaining two pairs of gray scale signals has two black color voltages.

Then, the three pairs of gray scale signals are applied to the first pixel PX1 and the second pixel PX2 to display the gray scale (S70).

The first sub-pixel SPX1 and the fourth sub-pixel SPX4, to which the first pair of gray scale signals are applied, reflect the light having the blue wavelength and the light having the yellow wavelength, respectively. The second sub-pixel SPX2 and the fifth sub-pixel SPX5, to which the second pair of gray scale signals are applied, transmit the lights incident thereto. The third sub-pixel SPX3 and the sixth sub-pixel SPX6, to which the third pair of gray scale signals are applied, transmit the lights incident thereto. Thus, the second gray scale 2G shown in FIG. 11A is displayed.

Hereinafter, the driving method of the display apparatus when the first, second and third color image data Rd, Gd and Bd does not have the same gray scale value, will be described in detail with reference to FIG. 10.

When the first, second and third color image data Rd, Gd and Bd does not have the same gray scale value, that is, any one of gray scale values of the first, second and third color image data Rd, Gd and Bd is different from another in the first, second and third color image data Rd, Gd and Bd, as shown in FIG. 11B, the color image including a plurality of gray scales, e.g., the color image divided into ten-level gray scale 1GC to 10GC, is displayed in the area corresponding to the first pixel PX1.

When any one of gray scale values of the first, second and third color image data Rd, Gd and Bd is different from another in the first, second and third color image data Rd, Gd and Bd, the first, second and third color image data Rd, Gd and Bd are converted to the HSI values (S40). In an exemplary embodiment, the image data comparator-converter 200-1 converts the first, second and third color image data Rd, Gd and Bd into the HSI values.

As shown in FIG. 12, when the second and third color image data Gd and Bd have the same gray scale value and the first color image data Rd has the gray scale value larger than the gray scale value of the second and third color image data Gd and Bd, the first, second and third color image data Rd, G and Bd may be converted into the HSI values, as shown in FIG. 13. The image data comparator-converter 200-1 generates the color data HD including the color information, the chroma data SD including the color information, and the brightness data ID including the brightness information based on the first, second and third color image data Rd, Gd and Bd.

In an exemplary embodiment, the HSI conversion satisfies the following Equations 5 to 7.

$$I = \frac{1}{3}(Gr + Gg + Gb) \quad \text{[Equation 5]}$$

$$S = I - \frac{1}{Gr + Gg + Gb}[\min(Gr, Gg, Gb] \quad \text{[Equation 6]}$$

$$H = \cos^{-1}\left[\frac{\frac{1}{2}[(Gr - Gg) + (Gr - Gb)]}{\sqrt{(Gr - Gg)^2 + (Gr - Gb)(Gg - Gb)}}\right] \quad \text{[Equation 7]}$$

In Equations 5 to 7, "I" denotes a brightness data value, "S" denotes a chroma data value, and "H" denotes a color data value.

Each of the color data HD, the chroma data SD and the brightness data ID of the color image 4GC in FIG. 13 has four-leveled gray scale. The chroma data SD determines an area to be displayed, and the chroma data SD is divided into four levels from a first level to a fourth level. The brightness data ID determines if the white color or black color is displayed in the area in which the color is displayed.

In an exemplary embodiment, when the color image 4GC having the four-leveled gray scale shown in FIG. 11B, the color data HD indicates the red color, the chroma data SD indicates the first level, and brightness data ID indicates the third level under Equations 5 to 7 as shown in FIG. 13.

The chroma level is determined based on the level of the chroma data in which the value obtained by Equation 6 is included, and the brightness level is determined based on the level of the brightness data in which the value obtained by Equation 5 is included.

In an exemplary embodiment, when the color image 2GC having the two-level gray scale shown in FIG. 11B is displayed, the color data HD indicates the red color, the chroma data SD indicates the first level, and brightness data ID indicates the first level under Equations 5 to 7 as shown in FIG. 13.

Then, the three pairs of color signals are generated based on the color data HD, the chroma data SD and the brightness data ID (S50).

The timing controller 310 generates the three color data CD1, CD2 and CD3 based on the color data HD, the chroma data SD and the brightness data ID, and the data driver 330 generates the three pairs of color signals (refer to FIGS. 8A and 8B) based on the three f color data CD1, CD2 and CD3.

In such an embodiment, the three color data CD1, CD2 and CD3 may be generated based on the data shown in FIG. 13 to display the color image 4GC having the four-level gray scale.

To this end, the color information including the three the color data CD1, CD2 and CD3 is determined based on the color data HD. Then, a color data of the three color data CD1, CD2 and CD3 is determined to have the color information decided by the color data HD based on the chroma data SD. The blue color information, the yellow color information or the black color information are provided to the color data that does not include the color information based on the color data HD.

In such an embodiment, a first color data CD1 includes the color data having the red color information and the color data having the black color information. Each of a second color data CD2 and a third color data CD3 include the color data having the blue color information and the color data having the yellow color information.

The three pairs of color signals are generated based on the three color data CD1, CD2 and CD3. The first pair of color signals includes the red color voltage and the black color voltage, the second pair of color signals includes the blue color voltage, and the third pair of color signals includes the yellow color voltage.

The three pairs of color signals are applied to the first pixel PX1 and the second pixel PX2 to display the color image (S70).

In an exemplary embodiment, the first sub-pixel SPX1 receives the red color voltage of the first pair of color signals to reflect the light in the red wavelength and the fourth sub-pixel SPX4 receives the black color voltage of the first pair of color signals to transmit the light incident thereto. The second sub-pixel SPX2 receives the blue color voltage of the second pair of color signals to reflect the light in the blue wavelength and the fifth sub-pixel SPX5 receives the yellow color voltage of the second pair of color signals reflect the light in the yellow wavelength. The third sub-pixel SPX3 receives the blue color voltage of the third pair of color signals to reflect the light in the blue wavelength, and the sixth sub-pixel SPX6 receives the yellow color voltage of the third pair of color signals to reflect the light in the yellow wavelength. In such an embodiment, the red color image 4GC having the four-level gray scale shown in FIG. 11B is displayed.

Although the exemplary embodiments of the invention have been described, it is understood that the invention should not be limited to these exemplary embodiments but various changes and modifications may be made by one ordinary skilled in the art within the spirit and scope of the invention as hereinafter claimed.

What is claimed is:

1. A display apparatus comprising:

an image data comparator which receives a pixel image data including a first color image data, a second color image data and a third color image data, extracts a first image data, a second image data and a third image data from the first color image data, the second color image data and the third color image data by comparing gray scale values of the first color image date, the second color image data and the third color image data with each other such that each of a grayscale value of the second image data and a grayscale value of the third image data is greater than or equal to a gray scale value of the first image data, and compares the gray scale value of the first image data with a predetermined gray scale value;

a driving circuit which generates a gray scale signal based on a compared result of the gray scale value of the first image data and the predetermined gray scale value and generates a first color signal and a second color signal based on at least one of the first image data, the second image data and the third image data, wherein each of the first and second color signals includes at least one color information; and a pixel including a first sub-pixel which receives a gray voltage corresponding to the gray scale signal to display a gray scale, a second sub-pixel which receives a first driving voltage corresponding to the first color signal to display at least two primary colors, and a third sub-pixel which receives a second driving voltage corresponding to the second color signal to display at least two primary colors, wherein a wavelength of each color displayed from the second sub-pixel and the third sub-pixel is corresponding to each of the first driving voltage and the second driving voltage, wherein the predetermined gray scale value is obtained by multiplying a maximum gray scale value of the pixel image data by a ratio of a maximum reflectance of the first sub-pixel to a maximum reflectance of the pixel.

2. The display apparatus of claim 1, wherein when the gray scale value of the first image data is less than the predetermined gray scale value, the driving circuit generates the gray scale signal based on the first image data, and the first sub-pixel displays a gray scale corresponding to a gray scale level in gray scale levels from a black gray scale to a white gray scale based on a ratio of the gray scale value of the first image data to the predetermined gray scale value.

3. The display apparatus of claim 2, wherein the driving circuit generates the first color signal based on the second image data, the first color signal includes at least one of a first color voltage having first color information or a black voltage having black color information, and the second sub-pixel displays a first color corresponding to the first color information or a black color corresponding to the black color information.

4. The display apparatus of claim 3, wherein the second sub-pixel successively displays the first color and the black color, and a time ratio, in which the first color and the black color are displayed, satisfies the following Equation, $$C1t:Bk1t=(G2-G1):(Mg-G2),$$

wherein C1*t* denotes a time period during which the first color is displayed in the second sub-pixel, Bk1*t* denotes a time period during which the black color is displayed in the second sub-pixel, G2 is the gray scale value of the second image data, G1 is the gray scale value of the first image data, and Mg is the maximum gray scale value.

5. The display apparatus of claim 2, wherein the driving circuit generates the second color signal based on the third image data, the second color signal includes at least one of a second color voltage having second color information or a black voltage having black color information, and the third sub-pixel displays a second color corresponding to the second color information or a black color corresponding to the black color information.

6. The display apparatus of claim 5, wherein the third sub-pixel successively displays the second color and the black color, and a time ratio, in which the second color and the black color are displayed, satisfies the following Equation, $$C2t:Bk2t=(G3-G1):(Mg-G3),$$

wherein C2*t* denotes a time period during which the second color is displayed in the third sub-pixel, Bk2*t* denotes a time period during which the black color is displayed in the third sub-pixel, G3 is the gray scale value of the third image data, G1 is the gray scale value of the first image data, and Mg is the maximum gray scale value.

7. The display apparatus of claim 1, wherein the image data comparator extracts a color image data having a highest gray scale value among the first color image data, the second color image data and the third color image data as the second image data.

8. The display apparatus of claim 7, wherein when the gray scale value of the first image data is greater than or equal to the predetermined gray scale value, the driving circuit generates a gray scale signal, which allows the first sub-pixel to have the maximum reflectance, and the first sub-pixel displays a white gray scale.

9. The display apparatus of claim 8, wherein the driving circuit generates the first color signal based on the first image data and the second image data, the fist color signal includes at least one of a first color voltage having first color information or a black voltage having black color information, and the second sub-pixel displays a first color corresponding to the first color information or a black color corresponding to the black color information.

10. The display apparatus of claim 9, wherein when the gray scale value of the first image data is greater than the predetermined gray scale value, the first color information corresponds to an intermediate color obtained by mixing a color corresponding to the color information of the first image data with a color corresponding to the color information of the second image data.

11. The display apparatus of claim 10, wherein the second sub-pixel successively displays the first color and the second color, and a time ratio, in which the first color and the second color are displayed, satisfies the following Equation, $$C3t:C4t=(G1-Cg):(G2-G1),$$

wherein C3*t* denotes a time period during which the first color is displayed in the second sub-pixel, C4*t* denotes a time period during which the second color is displayed in the second sub-pixel, G1 denotes the gray scale value of the first image data, G2 denotes the gray scale value of the second image data, and Cg denotes the predetermined gray scale value.

12. The display apparatus of claim 9, wherein the driving circuit generates the second color signal based on the third image data, the second color signal includes at least one of a third color voltage having third color information or a black voltage having black color information, and the third sub-pixel displays a third color corresponding to the third color information or a black color corresponding to the black color information.

13. The display apparatus of claim 12, wherein the third sub-pixel successively displays the third color and the black color, and a time ratio, in which the third color and the black color are displayed, satisfies the following Equation, $$C5t:C6t=(G3-Cg):(G2-G3),$$

wherein C5*t* denotes a time period during which the third color is displayed in the third sub-pixel, C6*t* denotes a time period during which the black color is displayed in the third sub-pixel, G3 denotes the gray scale value of the third image data, Cg denotes the predetermined gray scale value, G2 denotes the gray scale value of the second image data, and G2 is greater than or equal to G3.

14. The display apparatus of claim 1, further comprising:

a display panel comprising:

a first substrate including a plurality of first lines extending in a first direction, and a plurality of second lines extending in a second direction crossing the first direction and insulated from the first lines, wherein each of the second lines includes a first sub-line, a second sub-line and a third sub-line; and a second substrate spaced apart from the first substrate and including a common electrode disposed on a surface thereof facing the first substrate.

15. The display apparatus of claim 14, wherein the first sub-pixel comprises:

a first sub-pixel electrode disposed on the first substrate;

a first thin film transistor connected to the first sub-line, the first sub-pixel electrode and one of the first lines; and an electrophoretic material interposed between the first sub-pixel electrode and the common electrode.

16. The display apparatus of claim 15, wherein the second sub-pixel comprises:

a second sub-pixel electrode disposed on the first substrate;

a second thin film transistor connected to the second sub-line, the second sub-pixel electrode and the one of the first lines, to which the first thin film transistor is connected; and a photonic crystal material interposed between the second sub-pixel electrode and the common electrode, and the third sub-pixel comprises:

a third sub-pixel electrode disposed on the first substrate;

a third thin film transistor connected to the third sub-line, the third sub-pixel electrode and the one of the first lines, to which the first thin film transistor is connected; and a photonic crystal material interposed between the third sub-pixel electrode and the common electrode.

17. A method of driving a display apparatus comprising a pixel including a first sub-pixel which displays a gray scale, a second sub-pixel which displays at least two different primary colors of three different primary colors, and a third sub-pixel which displays at least two different primary colors of the three different primary colors, the method comprising:

receiving a pixel image data including a first color image data, a second color image data and a third color image data;

extracting a first image, a second image data and a third image data by comparing gray scale values of the first color image date, the second color image data and the third color image data with each other such that each of a grayscale value of the second image data and a grayscale value of the third image data is greater than or equal to a gray scale value of the first image data;

comparing the gray scale value of the first image data with a predetermined gray scale value;

generating a gray scale signal based on the comparing the gray scale value of the first image data and the predetermined gray scale value;

generating a first color signal and a second color signal based on at least one of the first image data, the second image data and the third image data, wherein each of the first and second color signals includes at least one color information;

applying a gray voltage corresponding to the gray scale signal to the first sub-pixel to display a gray scale corresponding to a gray scale level in gray scale levels from a black gray scale to a white gray scale; and respectively applying a first driving voltage corresponding to the first color signal and a second driving voltage corresponding to the second color signal to the second sub-pixel and the third sub-pixel to display the at least one color, wherein a wavelength of each color displayed from the second sub-pixel and the third sub-pixel is corresponding to each of the first driving voltage and the second driving voltage, wherein the predetermined gray scale value is obtained by multiplying a maximum grayscale value of the pixel image data by a ratio of a maximum reflectance of the first sub-pixel to a maximum reflectance of the pixel.

* * * * *